US010466604B2

(12) United States Patent
Toshine et al.

(10) Patent No.: US 10,466,604 B2
(45) Date of Patent: Nov. 5, 2019

(54) ELECTROPHOTOGRAPHIC PHOTOCONDUCTOR, IMAGE FORMING APPARATUS, AND PROCESS CARTRIDGE

(71) Applicants: Tetsuya Toshine, Shizuoka (JP); Mitsuaki Hirose, Shizuoka (JP); Tomoharu Asano, Kanagawa (JP)

(72) Inventors: Tetsuya Toshine, Shizuoka (JP); Mitsuaki Hirose, Shizuoka (JP); Tomoharu Asano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/025,351

(22) Filed: Jul. 2, 2018

(65) Prior Publication Data

US 2019/0011845 A1 Jan. 10, 2019

(30) Foreign Application Priority Data

Jul. 4, 2017 (JP) ..... 2017-131052

(51) Int. Cl.
*G03G 5/14* (2006.01)

(52) U.S. Cl.
CPC ..... *G03G 5/144* (2013.01); *G03G 5/142* (2013.01)

(58) Field of Classification Search
CPC ..... G03G 5/144; G03G 5/142
See application file for complete search history.

(56) References Cited

U.S. PATENT DOCUMENTS

| | | | | |
|---|---|---|---|---|
| 5,489,496 | A | 2/1996 | Katayama et al. | |
| 5,763,127 | A * | 6/1998 | Goshima | G03G 5/142 430/62 |
| 5,834,146 | A | 11/1998 | Hoshizaki et al. | |
| 8,126,360 | B2 | 2/2012 | Kawasaki et al. | |
| 8,129,082 | B2 | 3/2012 | Sarayama et al. | |
| 8,263,300 | B2 | 9/2012 | Toshine | |
| 8,507,163 | B2 | 8/2013 | Tamoto et al. | |
| 8,535,863 | B2 | 9/2013 | Asano et al. | |

(Continued)

FOREIGN PATENT DOCUMENTS

| | | |
|---|---|---|
| JP | 08-166679 | 6/1996 |
| JP | 10-254158 | 9/1998 |

(Continued)

OTHER PUBLICATIONS

English language translation of JP 2014-199400 (Oct. 2014).*

*Primary Examiner* — Christopher D Rodee
(74) *Attorney, Agent, or Firm* — Oblon, McClelland, Maier & Neustadt, L.L.P.

(57) ABSTRACT

Provided is an electrophotographic photoconductor including: a conductive support; an undercoat layer; and a photoconductive layer, wherein the undercoat layer and the photoconductive layer are provided over the conductive support in the order of reciting, wherein the undercoat layer contains at least metal oxide particles, a binder, and a salicylic acid derivative such as 4-methylsalicylic acid, wherein the metal oxide particles have a volume resistivity of $1\times10^5$ Ω·cm or higher but $1\times10^8$ Ω·cm or lower, wherein the undercoat layer has a volume resistivity of $0.001\times10^6$ Ω·cm or higher but $0.02\times10^6$ Ω·cm or lower, and wherein the undercoat layer has a thickness of 2 micrometers or greater but 20 micrometers or less.

19 Claims, 4 Drawing Sheets

(56) References Cited

U.S. PATENT DOCUMENTS 8,652,717 B2 2/2014 Shimoyama et al.
8,798,487 B2 8/2014 Asano et al.
8,867,960 B2 10/2014 Toda et al.
8,927,183 B2 1/2015 Kawasaki et al.
9,031,491 B2 5/2015 Asano et al.
9,037,067 B2 5/2015 Ikuno et al.
2006/0014090 A1 1/2006 Shiino et al.
2006/0014092 A1 1/2006 Nukada et al.
2006/0110668 A1 5/2006 Kawasaki et al.
2007/0031746 A1 2/2007 Toshine et al.
2007/0092816 A1* 4/2007 Wu ..... G03G 5/142 430/65
2007/0196749 A1 8/2007 Inaba et al.
2007/0196750 A1 8/2007 Fujiwara et al.
2007/0212626 A1 9/2007 Toshine et al.
2007/0231720 A1 10/2007 Mori et al.
2007/0297836 A1 12/2007 Kawasaki et al.
2008/0038649 A1 2/2008 Hirose et al.
2008/0063962 A1 3/2008 Toshine et al.
2008/0102391 A1 5/2008 Yanagawa et al.
2008/0124638 A1 5/2008 Hirose et al.
2009/0028607 A1 1/2009 Hamasaki et al.
2010/0330475 A1 12/2010 Tamoto et al.
2011/0020740 A1 1/2011 Sugino et al.
2011/0059393 A1 3/2011 Tamoto et al.
2011/0286777 A1 11/2011 Sugino et al.
2012/0121291 A1* 5/2012 Tsuji ..... G03G 5/102 399/111
2012/0321348 A1 12/2012 Toriu et al.
2013/0011147 A1 1/2013 Kimura et al.
2013/0022902 A1 1/2013 Shimoyama et al.
2013/0059242 A1 3/2013 Asano et al.
2013/0059243 A1 3/2013 Hirose et al.
2013/0243483 A1 9/2013 Hirose et al.
2013/0244150 A1 9/2013 Toshine et al.
2013/0330104 A1 12/2013 Shimoyama et al.
2014/0064810 A1 3/2014 Iwamoto et al.
2014/0199620 A1 7/2014 Ishida et al.
2014/0234763 A1 8/2014 Sugino et al.
2015/0071678 A1 3/2015 Ikuno et al.
2015/0168856 A1 6/2015 Kurimoto et al.
2015/0309430 A1 10/2015 Nii et al.
2015/0316865 A1* 11/2015 Noguchi ..... G03G 5/0542 430/56
2016/0139517 A1 5/2016 Ishida et al.
2016/0161871 A1 6/2016 Asano et al.
2016/0272805 A1* 9/2016 Nakanishi ..... B32B 27/36
2016/0327877 A1 11/2016 Kurimoto et al.
2016/0334720 A1 11/2016 Ishida et al.
2017/0153559 A1 6/2017 Asano et al.
2017/0212435 A1 7/2017 Hirose et al.
2017/0307988 A1 10/2017 Asano et al.
2017/0343908 A1 11/2017 Takahashi et al.
2017/0343910 A1 11/2017 Ishida et al.

FOREIGN PATENT DOCUMENTS

JP 10-254160 9/1998
JP 11-109670 4/1999
JP 11-133649 5/1999
JP 2967724 8/1999
JP 11-295913 10/1999
JP 3053734 4/2000
JP 3126889 11/2000
JP 2002-341569 11/2002
JP 2003-021948 1/2003
JP 2003-122039 4/2003
JP 2003-186219 7/2003
JP 2003-316113 11/2003
JP 2004-233612 8/2004
JP 2004-240057 8/2004
JP 2005-084623 3/2005
JP 2005-114949 4/2005
JP 2006-030700 2/2006
JP 4196768 10/2008
JP 4201007 10/2008
JP 4228793 12/2008
JP 2009-025506 2/2009
JP 4370706 9/2009
JP 4456954 2/2010
JP 2010-224050 10/2010
JP 2011-128546 6/2011
JP 2012-058597 3/2012
JP 5384042 10/2013
JP 2014-199400 10/2014
JP 2014199400 A * 10/2014
JP 2016-126218 7/2016

* cited by examiner

ELECTROPHOTOGRAPHIC PHOTOCONDUCTOR, IMAGE FORMING APPARATUS, AND PROCESS CARTRIDGE

CROSS-REFERENCE TO RELATED APPLICATIONS

The present application claims priority under 35 U.S.C. § 119 to Japanese Patent Application No. 2017-131052 filed Jul. 4, 2017. The contents of which are incorporated herein by reference in their entirety.

BACKGROUND OF THE INVENTION

Field of the Invention

The present disclosure relates to an electrophotographic photoconductor, an image forming apparatus, and a process cartridge.

Description of the Related Art

In recent years, organic photoconductors (OPC) have often been used instead of inorganic photoconductors in copiers, facsimile machines, laser printers, and multifunction peripherals in which these machines are combined, because organic photoconductors have good performances and various advantages. The reasons for these advantages include, for example, (1) optical properties such as a wide light absorption wavelength range and a high absorption amount, (2) electric properties such as a highly-sensitive, stable charging property, (3) a wide selection range of materials, (4) ease of production, (5) a cost-saving property, and (6) nontoxicity.

Meanwhile, reduction of the diameter of electrophotographic photoconductors has proceeded along with the recent trend for downsizing image forming apparatuses, and there have also been tendencies toward machine acceleration and maintenance-free. Hence, electrophotographic photoconductors have come to be expected to have a longer life span and electrostatic property stability such as a long-term non-fluctuation of the electrostatic property.

Commonly known typical electrophotographic photoconductors include undercoat layers and photoconductive layers in this laminating order over conductive supports. In common photoconductive layers, charge generating layers and charge transport layers are laminated in this order. Many of these constituent components are formed of organic compounds. Organic compounds gradually deteriorate through repetition of charging/exposure processes in the electrophotographic process, and have constituted one factor for degradation of the electrostatic property. Moreover, it has been found that in the electrophotographic photoconductors having the multi-layer configuration described above, the charge transport function of each layer and the charge injecting property at the interface of each layer have relation with degradation of the electrostatic property due to repetitive use. For example, it has been known that when there is a discrepancy between the HOMO level of the charge generating material used in the charge generating layer and the HOMO level of the charge transport material used in the charge transport layer, there occur electrostatic property changes due to repetitive use. Likewise, when the undercoat layer has a poor charge transport property or when the charge injecting property is poor between the charge generating layer and the undercoat layer, there occur electrostatic property changes due to repetitive use as in the case described above. Furthermore, the undercoat layer is deeply related with the charging property of the electrophotographic photoconductor. When the charging property related with the undercoat layer has a poor stability, the electrophotographic photoconductor undergoes charging property changes due to repetitive use.

The electrostatic property and the charging property that are related with the undercoat layer are conflicting properties, and it is extremely difficult to satisfy both of these functions. So far, attempts to improve one of these properties have often resulted in degradation of the other of the properties. As a measure for satisfying both of these functions, there have been proposed methods of improving a charge injection inhibiting function using a silane coupling agent containing an amino group (for example, see Japanese Unexamined Patent Application Publication No. 08-166679 and Japanese Unexamined Patent Application Publication No. 11-133649), and methods of adding additives such as an electron transport substance and an acceptor compound in the undercoat layer (for example, see Japanese Unexamined Patent Application Publication No. 2012-58597 and Japanese Unexamined Patent Application Publication No. 2006-030700). Particularly, Japanese Unexamined Patent Application Publication No. 2006-030700 proposes use, over a conductive support, of an undercoat layer containing metal oxide particles to which an acceptor compound (a hydroxyanthraquinone-based compound or an aminohydroxyanthraquinone-based compound) is attached. This makes it possible to obtain a stable electric property even in a long time of use, and to sufficiently prevent occurrence of leakage even if a foreign matter occurring from a member surrounding the electrophotographic photoconductor or dust entering the electrophotography apparatus from outside sticks in the electrophotographic photoconductor. However, the hydroxyanthraquinone-based compound and the aminohydroxyanthraquinone-based compound have a high crystallinity. Therefore, when these compounds are attached to metal oxide particles, the metal oxide particles tend to aggregate with each other. This makes the dispersion state in the undercoat layer nonuniform, and the electric property in a long time of use cannot be sufficiently stable.

SUMMARY OF THE INVENTION

The problems are solved by the configuration 1) described below.

1) An electrophotographic photoconductor that includes a conductive support, an undercoat layer, and a photoconductive layer.

The undercoat layer and the photoconductive layer are provided over the conductive support in the order of reciting.

The undercoat layer contains at least metal oxide particles, a binder, and a salicylic acid derivative represented by general formula (1) below.

When the metal oxide particles are formed as a compacted powder having a volume filling ratio of 50 vol %, the compacted powder has a volume resistivity of $1\times10^5$ Ω·cm or higher but $1\times10^8$ Ω·cm or lower.

The undercoat layer has a volume resistivity of $0.001\times10^6$ Ω·cm or higher but $0.02\times10^6$ Ω·cm or lower at a field intensity of $5\times10^6$ V/m.

The undercoat layer has a thickness of 2 micrometers or greater but 20 micrometers or less.

[General formula (1)]

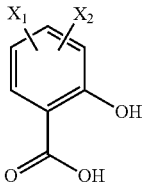

(In the formula, $X_1$ and $X_2$ represent a hydrogen atom, an alkyl group, an alkoxy group, an aralkyl group, an aryl group, a hydroxyl group, a carboxyl group, or a carbonyl group, and $X_1$ and $X_2$ may be the same or different.)

DESCRIPTION OF THE EMBODIMENTS

Figure 1:
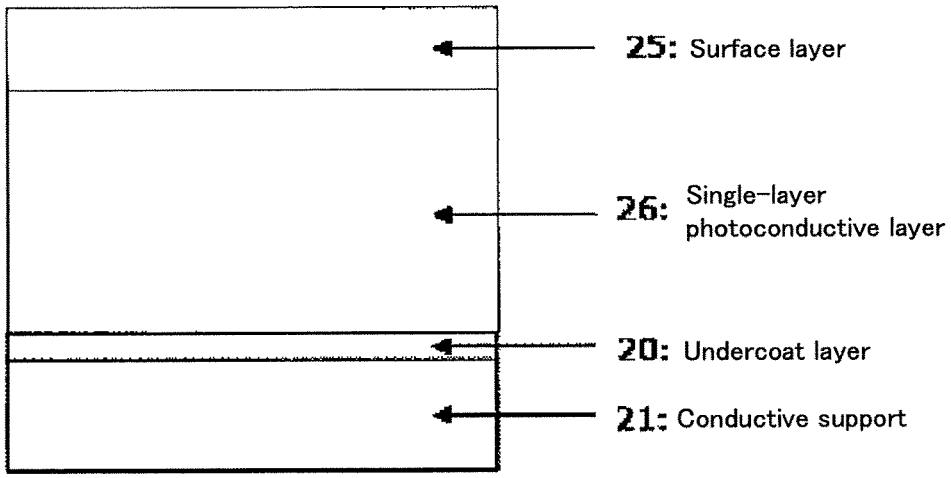
FIG. 1 is a cross-sectional view illustrating an example of an electrophotographic photoconductor of the present disclosure.

The present disclosure has an object to provide an electrophotographic photoconductor that has an extremely high electric property stability even through repetition of image outputting, suppresses as much as possible occurrence of, particularly, residual image among image defects, and can output stable images for a long term.

The present disclosure can provide an electrophotographic photoconductor that has an extremely high electric property stability even through repetition of image outputting, suppresses as much as possible occurrence of, particularly, residual image among image defects, and can output stable images for a long term.

As a result of earnest studies, the present inventors have reached the subject matter of the present disclosure based on a finding that the constituent components and the volume resistivity of a layer (so-called undercoat layer) contacting a conductive support of an electrophotographic photoconductor are related with the electric property stability of the photoconductor through repetitive use and have a remarkable effect on suppression of occurrence of, particularly, residual image among image defects.

In order to suppress electrostatic property changes attributable to the undercoat layer and maintain a high functionality for a long term, what matters is to adjust the volume resistivity of the undercoat layer, selectively transport charges of a desired polarity, and set a high charge transport property for the polarity while suppressing a charge transport property for an undesired polarity as much as possible. It has been known that commonly known layered electrophotographic photoconductors exhibit a negative chargeability and that the photoconductive layers exhibit a p-type semiconductivity. Therefore, it is preferable that the undercoat layer be formed of an n-type semiconductor. Hence, what counts is selection of materials, composition, and film morphology that bring about an n-type semiconductivity.

(Constituent Components of Undercoat Layer)

The constituent components of the undercoat layer include at least metal oxide particles, a binder, and a salicylic acid derivative represented by general formula (1) above.

(Metal Oxide Particles)

The present disclosure is characterized in that metal oxide particles are dispersed in the undercoat layer, in order to impart a charge transport property for a desired polarity to the undercoat layer and obtain a desired volume resistivity. Examples of metal oxide particles that can be used include titanium oxide, tin oxide, zinc oxide, zirconium oxide, indium oxide, antimony oxide, calcium oxide, ITO, silicon oxide, colloidal silica, aluminum oxide, yttrium oxide, cobalt oxide, copper oxide, iron oxide, manganese oxide, niobium oxide, vanadium oxide, and selenium oxide. As needed, two or more kinds of metal oxide particles may be used in combination. Among these kinds of metal oxide particles, it is preferable to select metal oxide species having a relatively high conductivity and an excellent stability over time in the atmosphere, when considering control on the surface resistivity of the undercoat layer. It is commonly known that metal oxide particles exhibit a stable property in the atmosphere. Particularly, titanium oxide and zinc oxide are suitable, because these metal oxide particles exhibit a stable electric property for a long term. Particularly, zinc oxide can be more suitably used for controlling the charge transport property of the undercoat layer, because the resistivity of zinc oxide can be easily adjusted by doping zinc oxide with a Group XIII element. Examples of Group XIII elements to be doped include boron, aluminum, gallium, and indium. Aluminum and gallium are suitable in terms of the electric property stability, and aluminum is the best suitable in terms of resistivity control of the undercoat layer described below and the denseness of the undercoat layer.

The element equivalent content of the Group XIII element in the zinc oxide particles is preferably in a range of from 0.001 moles through 0.2 moles, more preferably in a range of from 0.01 moles through 0.1 moles, and particularly preferably in a range of from 0.02 moles through 0.1 moles relative to 1 mole of zinc oxide. It is not preferable that the content of the Group XIII element be less than 0.001 moles, because the electric property stability of the zinc oxide particles tend to degrade. It is also not preferable that the content of the Group XIII element be greater than 0.2 moles, because the electric property stability and the conductivity improving effect of the particles tend to be saturated, and an excessive amount of the added element that may not be diffused to effective locations tends to deposit at the grain boundary in the form of a compound, leading to a risk of degrading various properties of the electrophotographic photoconductor.

So long as the volume resistivity of the undercoat layer of the present disclosure can be obtained, the metal oxide particles may be used as is, or may be surface-modified with a compound having a reactive organic group with a view to, for example, dispersibility improvement. The reactive organic group may have reactivity with, for example, a hydroxyl group on the surface of the metal oxide. An organometal coupling agent is commonly used as the reactive organic group. Examples of the organometal coupling agent include silane coupling agents such as hexyltrimethoxysilane, octyltrimethoxysilane, and methacryloxypropyl trimethoxysilane, titanate coupling agents such as isopropyl tris(dioctylpyrophosphate) titanate, tetra(2,2-diallyloxymethyl-1-butyl)bis(ditridecyl)phosphite titanate, and isopropyl triisostearoyl titanate, and aluminum coupling agents such as acetoalkoxyaluminum diisopropylate. One of the organometal coupling agents may be used alone or two or more of the organometal coupling agents may be used in combination.

The coating amount of the organometal coupling agent is preferably from 0.01% by mass through 30% by mass and more preferably from 0.05% by mass to 15% by mass relative to the metal oxide particles, although depending on the function desired to be enhanced and the dispersibility of the base particles. When the coating amount of the organometal coupling agent is less than 0.01% by mass, the function enhancing effect and the dispersibility improving effect are less likely to be obtained. When the coating amount of the organometal coupling agent is greater than 30% by mass, the organometal coupling agent is excessively attached to the metal oxide particles. This is not favorable because the properties of the electrophotographic photoconductor may be degraded.

Examples of the method for coating the surface of the metal oxide particles with the organometal coupling agent include a dry method of stirring the metal oxide particles in a high-speed stirrer such as a Henschel mixer while adding the organometal coupling agent or an aqueous or alcohol solution of the organometal coupling agent to obtained a uniformly stirred state and subsequently drying the resultant, and a wet method of dispersing the metal oxide particles in water or an alcohol to prepare a slurry, adding the organometal coupling agent or an aqueous or alcohol solution of the organometal coupling agent under stirring to obtain a sufficiently stirred state and subsequently filtrating, washing, and drying the resultant. Any of these methods may be used.

The average primary particle diameter of the metal oxide particles is preferably 50 nm or greater but 200 nm or less in terms of the charge transport property. It is not preferable that the average primary particle diameter of the metal oxide particles be less than 50 nm, because, although a homogeneous undercoat layer tends to be obtained and property stabilization can be expected, hopping conduction, which is a mode by which charges are often transported from particles to particles, occurs many times when the particle diameter is small, leading to degradation of the charge transport property and increase in the frequency of charge trap formation at the contact with a conductive support described below, consequently leading to possibilities of electrostatic property fluctuation due to repetitive use and image defects such as residual image due to the degradation of the charge transport property. It is not preferable that the average primary particle diameter of the metal oxide particle be greater than 200 nm, because the undercoat layer tends to become a nonhomogeneous coating film, making the electric property of the undercoat layer nonuniform and image defects such as background fog and image unevenness likely to occur.

The average primary particle diameter of the metal oxide particles is a value calculated with image analyzing software based on 200 particles randomly selected from an image of the metal oxide particles observed with a scanning electron microscope at the magnification of from ×3,000 through ×10,000.

The content of the metal oxide particles in the undercoat layer is not particularly limited so long as the volume resistivity of the present disclosure can be obtained. When the ratio of the metal oxide particles in the undercoat layer is too low, the volume resistivity of the present disclosure may not be obtained. When the ratio of the metal oxide particles in the undercoat layer is too high, there are risks of degrading the film forming performance for forming the undercoat layer and degrading the charging property of the electrophotographic photoconductor. When the ratio of the metal oxide particles in the undercoat layer is from about 30 vol % through 65 vol %, control to the volume resistivity of the present disclosure is easily available and suppression of the degradation of the film forming performance and the electrostatic property of the undercoat layer can be expected.

As a method for quantifying the ratio of the metal oxide particles in the undercoat layer, elemental analysis and elemental analysis mapping can be employed. The method for elemental analysis/mapping can be performed with, for example, an energy-dispersive X-ray spectrometer/scanning electron microscope (EDS-SEM). The EDS-SEM is a device configured to scan an observation target with a converged electron beam and detect the amount of secondary electrons to be emitted to observe the image of the surface of the observation target minutely (typically at the magnification of from ×50 through ×300,000), and simultaneously detect characteristic X-rays generated by the electron beam irradiation to perform analysis of the element ratio in a minute region on the surface and mapping of a specific element.

The content of the metal oxide particles can be quantified by elemental analysis/mapping of a cross-section of the electrophotographic photoconductor by the method described above. First, a cross-sectional structure of the electrophotographic photoconductor is exposed by a commonly used method such as a microtome and an FIB. Subsequently, mapping of the constituent elements of the metal oxide particles in the cross-section of the electrophotographic photoconductor is performed by the method described above, and the area in which the constituent elements of the metal oxide particles are detected is divided by the observed area, to obtain the area ratio of the area occupied by the metal oxide particles in the observed cross-section. Next, the area ratio is converted to a volume ratio (the 3/2 power of the area ratio). In this way, the ratio of the metal oxide particles in the undercoat layer can be obtained.

As the method for dispersing the metal oxide particles in the undercoat layer, a dispersing method commonly used for an undercoat layer coating liquid described below may be used. Examples of the dispersing method include a ball mill, a sand mill, a KD mill, a three-roll mill, a pressure-type homogenizer, and an ultrasonic disperser.

(Measurement of Volume Resistivity of Metal Oxide Particles)

As a method for measuring the volume resistivity of the metal oxide particles, there is a method of measuring a current value when a predetermined voltage is applied across electrodes that are provided on the upper and lower ends of a compacted powder produced by applying a predetermined pressure to a predetermined amount of a powder. In the present disclosure, for producing the compacted powder, two levels of pressures are applied to produce trial products, and the volume filling ratio of each compacted powder and the volume resistivity of each compacted powder are calculated. Subsequently, by exponential approximation, a volume resistivity at a volume filling ratio of 50 vol % is calculated as the volume resistivity of the metal oxide particles. The measurement conditions are described below.

The amount of the metal oxide particles used in the trial products: 1.0 g

The shape of the trial products: a cylinder (with a diameter of 20 mm)

The pressures for producing the trial products: 10 MPa and 20 MPa

The electrodes on the trial products: tungsten

The applied voltage: 0.1 V

The volume resistivity is defined by the formula below.

$$Rv=(W/C)/V$$

Rv: volume resistivity

W: weight of the sample (g)

C: true specific gravity ($g/cm^3$)

V: filling volume ($cm^3$)

In the present disclosure, there is a need that a compacted powder of the metal oxide particles at a volume filling ratio of 50 vol % have a volume resistivity of $1\times10^5$ Ω·cm or higher but $1\times10^8$ Ω·cm or lower. A more preferable range of the volume resistivity of the compacted powder is $1\times10^6$ Ω·cm or higher but $1\times10^8$ Ω·cm or lower.

(Salicylic Acid Derivative)

The salicylic acid derivative used in the present disclosure is represented by general formula (1) below.

[General formula (1)]

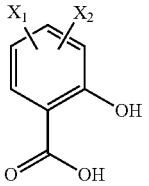

(In the formula, $X_1$ and $X_2$ represent a hydrogen atom, an alkyl group, an alkoxy group, an aralkyl group, an aryl group, a hydroxyl group, a carboxyl group, or a carbonyl group, and $X_1$ and $X_2$ may be the same or different.)

The salicylic acid derivative represented by general formula (1) stabilizes by forming a complex on the surface of the metal oxide particles, and imparts dispersion stability and electric property stability to the metal oxide particles.

In the salicylic acid derivative represented by general formula (1), $X_1$ and $X_2$ represent a hydrogen atom, an alkyl group, an alkoxy group, an aralkyl group, an aryl group, a hydroxyl group, a carboxyl group, or a carbonyl group, preferably a hydrogen atom, an alkyl group containing 4 or more carbon atoms, an alkoxy group containing 4 or more carbon atoms, or an aralkyl group containing 4 or more carbon atoms, and more preferably a hydrogen atom, a chain-like alkyl group containing from 4 through 20 carbon atoms, a cyclic alkyl group containing from 5 through 14 carbon atoms, an alkoxy group containing from 4 through 20 carbon atoms, or an aralkyl group containing from 7 through 20 carbon atoms.

Specific examples of the salicylic acid derivative represented by general formula (1) will be presented below. However, the present disclosure is not limited to the examples presented below. Specific examples include 2-hydroxybenzoic acid, 3-methylsalicylic acid, 4-methylsalicylic acid, 5-methylsalicylic acid, 3-ethylsalicylic acid, 4-ethylsalicylic acid, 5-ethylsalicylic acid, 3-butylsalicylic acid, 4-butylsalicylic acid, 5-butylsalicylic acid, 2,6-dihydroxy-4-methylbenzoic acid, 2,3-dihydroxybenzoic acid, 2,4-dihydroxybenzoic acid, 2,5-dihydroxybenzoic acid, 5-formylsalicylic acid, 2-hydroxyterephthalic acid, 2,5-dihydroxyterephthalic acid, 2,3,4-trihydroxybenzoic acid, 3-methoxysalicylic acid, 4-methoxysalicylic acid, 5-methoxysalicylic acid, 6-methoxysalicylic acid, 5-acetylsalicylic acid, 3,5-di-tert-butylsalicylic acid, 4-(2-hydroxyethoxy)salicylic acid, 3-phenylsalicylic acid, 4-hydroxyisophthalic acid, 2-hydroxyterephthalic acid, and 5-tert-butylisophthalic acid.

The salicylic acid derivatives represented by general formula (1) may be used alone or in combination. When 2 or more salicylic acid derivatives are used in combination, it is preferable to select and use compounds having similar acid values.

The amount of use of the salicylic acid derivative represented by general formula (1) is preferably from 0.5 parts by mass through 10 parts by mass and more preferably from 1 part by mass through 5 parts by mass relative to 100 parts by mass of the metal oxide particles. Preferable examples of the salicylic acid derivative represented by general formula (1) include 4-methylsalicylic acid, 3,5-di-tert-butylsalicylic acid, 3-butylsalicylic acid, and 5-butylsalicylic acid.

A dispersant, a surfactant, or any other chelate agent may be used in order to disperse the metal oxide particles in the undercoat layer in a favorable state. Known agents may be appropriately used as the dispersant, the surfactant, or any other chelate agent.

(Binder)

As the binder, it is desirable to use a resin having a high solvent resistance to common organic solvents, considering that a photoconductive layer described below is to be coated over the undercoat layer. Examples of such a resin include water-soluble resins such as polyvinyl alcohol, casein, and polysodium acrylate, alcohol-soluble resins such as copolyamide and methoxymethylated nylon, and curable resins that can form a three-dimensional network structure, such as polyurethane, melamine resin, phenol resin, alkyd-melamine resin, and epoxy resin. One or two or more of these resins may be selected and used. The amount of the binder is, for example, from 10 parts by mass through 200 parts by mass and preferably from 20 parts by mass through 100 parts by mass relative to 100 parts by mass of the metal oxide particles. The binder may be added before or after dispersion of the metal oxide particles. When the amount of the binder added is too low, it is difficult to form a good film of dispersed metal oxide particles. When the amount of the binder added is too high, a good electron transport function may not be expressed.

(Dispersing Method)

As the method for dispersing the metal oxide particles in the undercoat layer, a dispersing method commonly used for an undercoat layer coating liquid described below may be used. Examples of the dispersing method include a ball mill, a sand mill, a KD mill, a three-roll mill, a pressure-type homogenizer, and an ultrasonic disperser.

Use of the salicylic acid derivative enables a good dispersion of the metal oxide particles in the undercoat layer. In order to enhance the dispersibility even more, a dispersing aid and a surfactant may be used. Commonly used materials may be used as the dispersing aid and the surfactant. The amount of the dispersing aid or the surfactant to be blended is preferably from 0.5% by mass through 30% by mass and more preferably from 1% by mass through 15% by mass relative to the weight of the metal oxide particles, although depending on the particle diameter of the metal oxide particles. When the amount of the dispersing aid or the surfactant is lower than the mentioned value, the effect of dispersing the metal oxide particles may not be obtained. When the amount of the dispersing aid or the surfactant is too high, there is a risk of causing troubles such as a considerable rise of a residual potential. These materials may be used alone, or two or more kinds of these materials may be used as a mixture.

(Organic Solvent)

The solvent used in the undercoat layer coating liquid is not particularly limited so long as the solvent is a commonly used solvent. Examples of the solvent include alcohol-based solvents such as methanol, ethanol, propanol, and butanol, ketone-based solvents such as acetone, methyl ethyl ketone, methyl isobutyl ketone, and cyclohexanone, ester-based solvents such as ethyl acetate and butyl acetate, ether-based solvents such as tetrahydrofuran, dioxane, and propyl ether, halogen-based solvents such as dichloromethane, dichloroethane, trichloroethane, and chlorobenzene, aromatic solvents such as benzene, toluene, and xylene, and cellosolve-based solvents such as methylcellosolve, ethylcellosolve, and cellosolve acetate. One of these solvents may be used alone or two or more of these solvents may be used as a mixture.

(Other Additives)

Various additives may be used in the undercoat layer coating liquid in order to improve the electric property, environmental stability, and image quality. Examples of known materials that can be used as the additives include: electron transport substances such as quinone-based compounds (e.g., chloranil and bromanil), tetracyanoquinodimethane-based compounds, fluorenone compounds (e.g., 2,4,7-trinitrofluorenone and 2,4,5,7-tetranitro-9-fluorenone), oxadiazole-based compounds (e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone-based compounds, thiophene compounds, and diphenoquinone compounds such as 3,3',5,5'-tetra-t-butyldiphenoquinone; electron transport pigments such as polycyclic condensed pigments and azo-pigments; zirconium chelate compounds; titanium chelate compounds; aluminum chelate compounds; titanium alkoxide compounds; organotitanium compounds; and silane coupling agents.

(Film Forming Method)

A coating method used for forming the undercoat layer is not particularly limited so long as the coating method is a commonly used coating method, and may be appropriately selected depending on, for example, the viscosity of the coating liquid and the desired film thickness of the undercoat layer. For example, a dip coating method, a spray coating method, a bead coating method, and a ring coating method may be used.

After the coating liquid is coated, the formed undercoat layer may be heated and dried in, for example, an oven as needed. The drying temperature for drying the undercoat layer is preferably from 80 degrees C. through 200 degrees C. and more preferably from 100 degrees C. through 150 degrees C. although the drying temperature is different depending on the kind of the solvent contained in the undercoat layer coating liquid. When the drying temperature is too low, the solvent may remain. When the drying temperature is too high, organic materials may deteriorate and the undercoat layer may not be able to express a good function.

The thickness of the undercoat layer of the present disclosure needs to be 2 micrometers or greater but 20 micrometers or less and is preferably 3 micrometers or greater but 15 micrometers or less in consideration of the desired electric property and life span of the electrophotographic photoconductor. It is not preferable that the undercoat layer be thin, because charges having a reverse polarity to the charging polarity of the surface of the electrophotographic photoconductor flow into the photoconductive layer from the conductive support, leading to a charging failure and an accompanying background fog-like image defect. It is not preferable that the undercoat layer be too thick, because troubles are likely to occur, including degradation of an optical attenuating function such as rise of the residual potential, and degradation of repeating stability.

(Volume Resistivity of Undercoat Layer)

In the present disclosure, the volume resistivity of the undercoat layer at a field intensity of $5\times10^6$ V/m needs to be $0.001\times10^6$ Ω·cm or higher but $0.02\times10^6$ Ω·cm or lower. When the volume resistivity of the undercoat layer is not within this range, a desired effect may not be obtained.

The volume resistivity of the undercoat layer is more preferably $0.005\times10^6$ Ω·cm or higher but $0.015\times10^6$ Ω·cm or lower.

(Measurement of Volume Resistivity of Undercoat Layer)

Next, a method for measuring the volume resistivity of the undercoat layer will be described.

The volume resistivity of the undercoat layer can be measured by a commonly known method. For example, the volume resistivity of the undercoat layer can be measured according to JIS-C2139:2008 (solid insulating materials-Method for measuring volume resistivity and surface resistivity). Generally, many electrophotographic photoconductors have a cylinder shape, and the volume resistivity may be measured by a method described below if measurement by the method of the document mentioned above is difficult.

<Method for Producing Trial Product>

A trial product is produced by providing the undercoat layer over a conductive support and laminating an electrode having a known area over the surface of the coating film of the undercoat layer. The area of the electrode is preferably about 100 $mm^2$, but may be determined based on the capacity of a direct-current voltage source used for the measurement and the accuracy of an ammeter. Examples of the electrode material include gold, silver, copper, aluminum, nickel, platinum, chromium, zinc, and carbon that are commonly used. It is preferable that a counter electrode be formed of the same metal. The method for producing the electrode is not particularly limited so long as the constituent components of the undercoat layer will not be deteriorated by the method. A vacuum deposition method is preferable because the undercoat layer is unlikely to be deteriorated.

<Measuring Method>

The power source for applying a field is not particularly limited so long as the power source is a direct-current voltage source that is sufficiently stable. Use of a microammeter is preferable for measuring a current that flows through the trial product upon application of a voltage.

As the polarity of the voltage to be applied, it is preferable to apply a negative voltage when evaluating a negatively-chargeable electrophotographic photoconductor and apply a positive voltage when evaluating a positively-charging electrophotographic photoconductor. It is preferable to measure a current for 60 seconds or longer and calculate the volume resistivity based on the current value at the 60th second.

In the present disclosure, the measurement may be performed by the method described above under the conditions described below.

Current-voltage meter: SOURCE MEASURE UNIT TYPE 2410 available from Keithley Instruments Metal of electrode: gold Area of electrode: 100 $mm^2$ Measurement atmosphere: 25 degrees C./50% Rh Measurement time: 70 seconds (the volume resistivity is to be calculated based on a current value when 60 seconds has passed since application of a voltage)

Field intensity: $5\times10^6$ V/m (Photoconductive Layer)

Next, a photoconductive layer will be described.

[In the Case of Layered Configuration]

Figure 2:
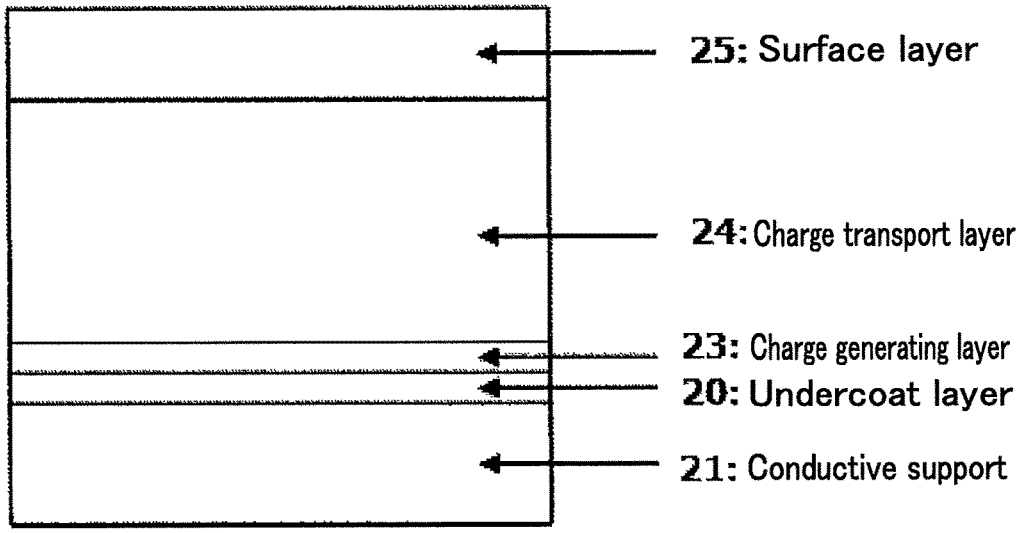
FIG. 2 is a cross-sectional view illustrating another example of an electrophotographic photoconductor of the present disclosure.
Figure 3:
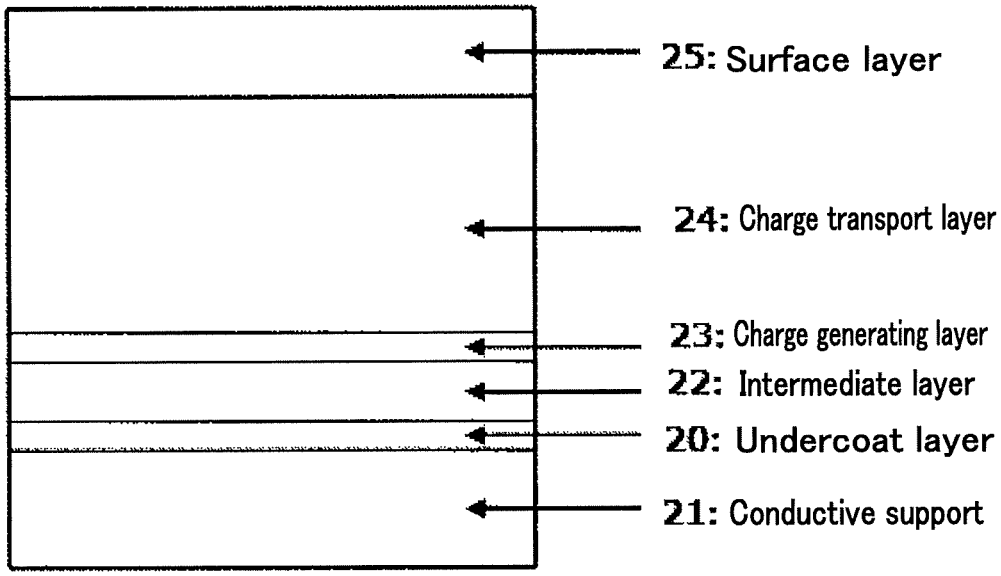
FIG. 3 is a cross-sectional view illustrating another example of an electrophotographic photoconductor of the present disclosure.
Figure 4:
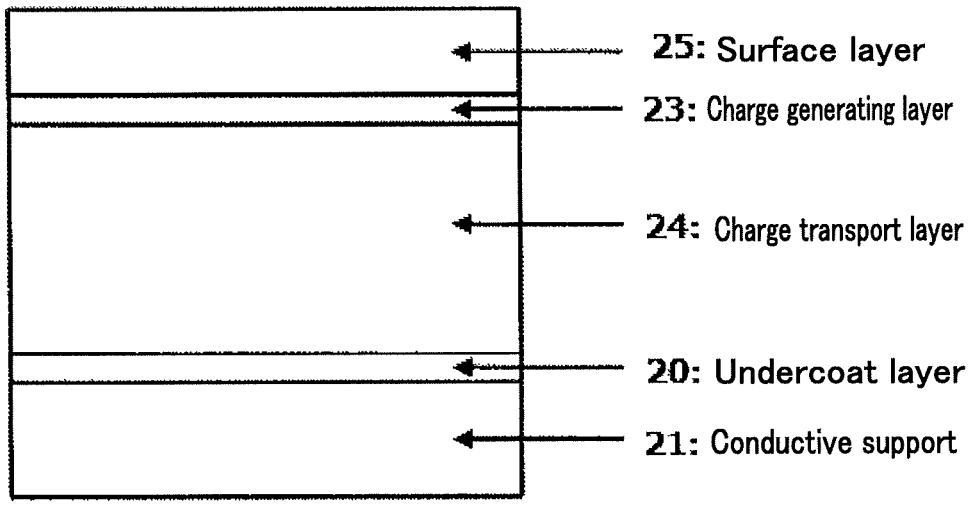
FIG. 4 is a cross-sectional view illustrating another example of an electrophotographic photoconductor of the present disclosure.

In a layered photoconductive layer, a charge generating function and a charge transport function are performed by different layers independently. Therefore, as illustrated in FIG. 2, the photoconductive layer has a layer configuration including at least an undercoat layer 20, a charge generating layer 23, and a charge transport layer 24 that are laminated over a conductive support 21. The layer laminating order is not particularly limited, and as illustrated in FIG. 4, the undercoat layer 20, the charge transport layer 24, and the charge generating layer 23 may be laminated in this order over the conductive support 21. However, many charge generating materials have a poor chemical stability, and undergo charge generating efficiency degradation when exposed to an acidic gas such as a discharge product around a charging device during an electrophotographic image forming process. Therefore, it is preferable to laminate the charge transport layer 24 over the charge generating layer 23 as illustrated in FIG. 2. With a view to, for example, improving wear resistance, a surface layer 25 may be provided as the outermost surface of the photoconductive layer, in addition to the charge generating layer 23 and the charge transport layer 24. As illustrated in FIG. 3, with a view to, for example, improving close adhesiveness, an intermediate layer 22 may be provided between the undercoat layer 20 and the charge generating layer 23.

<Charge Generating Layer>

The charge generating layer is a layer mainly formed of a charge generating substance having a charge generating function, and may also contain a binder resin in combination as needed. As the charge generating substance, an inorganic material and an organic material can be used.

Examples of the inorganic material include crystal selenium, amorphous selenium, selenium-tellurium, selenium-tellurium-halogen, selenium-arsenic compound, and amorphous silicon. As the amorphous silicon, amorphous silicon with a dangling bond terminated with a hydrogen atom or a halogen atom, and amorphous silicon doped with, for example, a boron atom or a phosphorus atom are suitable.

On the other hand, as the organic material, known materials can be used. Examples of known materials include phthalocyanine-based pigments such as metallophthalocyanine and metal-free phthalocyanine, azlenium salt pigments, squaric acid methine pigments, azo-pigments having a carbazole skeleton, azo-pigments having a triarylamine skeleton, azo-pigments having a diphenylamine skeleton, azo-pigments having a dibenzothiophene skeleton, azo-pigments having a fluorenone skeleton, azo-pigments having an oxadiazole skeleton, azo-pigments having a bisstilbene skeleton, azo-pigments having a distyryloxadiazole skeleton, azo-pigments having a distyrylcarbazole skeleton, perylene-based pigments, anthraquinone-based or polycyclic quinone-based pigments, quinoneimine-based pigments, diphenylmethane and triphenylmethane-based pigments, benzoquinone and naphthoquinone-based pigments, cyanine and azomethine-based pigments, indigoid-based pigments, and bisbenzimidazole-based pigments. One of these charge generating substances may be used alone or two or more of these charge generating substances may be used as a mixture.

Examples of the binder resin used in the charge generating layer as needed include polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose-based resins, casein, polyvinyl alcohol, and polyvinyl pyrrolidone. One of these binder resins may be used alone or two or more of these binder resins may be used as a mixture. An appropriate amount of the binder resin is from 0 parts by mass through 500 parts by mass and preferably from 10 parts by mass through 300 parts by mass relative to 100 parts by mass of the charge generating substance. The binder resin may be added before or after dispersion.

The method for forming the charge generating layer is roughly classified into a vacuum thin-film deposition method and a casting method based on a solution dispersion system. As the former method, for example, a vacuum deposition method, a glow discharge decomposition method, an ion plating method, a sputtering method, a reactive sputtering method, and a CVD method are used, and the inorganic material and the organic material described above can be formed in a favorable state. When using the latter casting method, the charge generating layer can be formed by dispersing the inorganic or organic charge generating substance described above, together with the binder resin as needed, in a solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, or butyl acetate using, for example, a ball mill, an attritor, a sand mill, or a bead mill, appropriately diluting the dispersion liquid, and coating the dispersion liquid. As needed, a leveling agent such as dimethyl silicone oil and methyl phenyl silicone oil may be added. The coating may be performed by, for example, a dip coating method, a spray coating method, a bead coating method, or a ring coating method.

An appropriate film thickness of the charge generating layer provided in the manner described above is about from 0.01 micrometers through 5 micrometers and preferably from 0.05 micrometers through 2 micrometers.

<Charge Transport Layer>

The charge transport layer is a layer having a charge transport function and is mainly formed of a charge transport substance or a polymeric charge transport substance and a binder resin.

(Binder Resin)

The binder resin is not particularly limited and may be appropriately selected from known materials depending on the intended purpose. Examples of the binder resin include thermoplastic or thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyallylate resins, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenol resins, and alkyd resins.

(Charge Transport Substance)

The charge transport substance is not particularly limited and may be appropriately selected depending on the intended purpose. Examples of the charge transport substance include known hole transport substances having a hole transport structure such as triarylamine, hydrazone, pyrazoline, and carbazole, and known electron transport substances having an electron transport structure such as condensed polycyclic quinone, diphenoquinone, and electron-withdrawing aromatic rings containing a cyano group or a nitro group. One of the hole transport substances or the electron transport substances may be used alone or two or more of the hole transport substances or the electron transport substances may be used as a mixture.

The content of the charge transport substance in the charge transport layer is preferably from 20% by mass through 80% by mass and more preferably from 30% by mass through 70% by mass relative to the total mass of the charge transport layer. When the content of the charge transport substance in the charge transport layer is less than 20% by mass relative to the total mass of the charge transport layer, the charge transport property of the charge transport layer may be poor and consequently a desired optical attenuating property may not be obtained. When the content of the charge transport substance in the charge transport layer is greater than 80% by mass, the photoconductor may be worn more than needed due to various hazards the photoconductor incurs from an electrophotography process. On the other hand, when the content of the charge transport substance in the charge transport layer is in the more preferable range, there is an advantage that a desired optical attenuating property can be obtained and an electrophotographic photoconductor that can be used with a small amount of wear can be obtained.

(Polymeric Charge Transport Substance)

As the charge transport substance, a polymeric charge transport substance may be used. A polymeric charge transport substance refers to a material that serves both of the function as the binder resin and the function as the charge transport substance.

The polymeric charge transport substance is not particularly limited and known materials may be used. The polymeric charge transport substance is preferably at least any polymer selected from the group consisting of polycarbonate, polyurethane, polyester, and polyether. Particularly, polycarbonate having a triarylamine structure in at least any one of a main chain and a side chain is preferable in terms of wear resistance and the charge transport property.

One of the polymeric charge transport substances may be used alone or two or more of the polymeric charge transport substances may be used in combination. The binder resin described above may also be used in combination in terms of wear resistance and film forming performance. When using the polymeric charge transport substance and the binder resin in combination for simultaneously satisfying the charge transport property, the content of the polymeric charge transport substance is preferably from 40% by mass through 90% by mass and more preferably from 50% by mass through 80% by mass relative to the total mass of the charge transport layer.

(Method for Forming Charge Transport Layer)

The charge transport layer can be formed by dissolving or dispersing the charge transport substance and the binder resin, or the polymeric charge transport substance and inorganic particles in an appropriate solvent, and coating and drying the obtained liquid.

Many of the constituent components of the charge transport layer are solid at normal temperature and normal pressure. Therefore, for producing the coating liquid, a solvent having a high affinity with each of the constituent components is used. The solvent to be used is not particularly limited so long as the solvent is a known solvent commonly used for painting and coating. One solvent may be used alone or two or more solvents may be used as a mixture.

The coating method used for forming the charge transport layer is not particularly limited, and a commonly used coating method may be used. An appropriate coating method may be selected depending on, for example, the viscosity of the coating liquid and the desired thickness of the charge transport layer. Examples of the coating method include a dip coating method, a spray coating method, a bead coating method, and a ring coating method.

As needed, a plasticizer and a leveling agent may be added in the charge transport layer.

The thickness of the charge transport layer is preferably 50 micrometers or less and more preferably 45 micrometers or less in terms of resolution and responsiveness. The lower limit of the thickness of the charge transport layer is preferably 5 micrometers or greater although the lower limit is different depending on the system to be used (particularly, for example, charging potential).

In terms of the electrophotographic property and the film viscosity, the charge transport layer formed by the method described above needs to be heated with some kind of measure in order to remove the solvent from the film Examples of thermal energy that can be used include gases such as air and nitrogen, vapor, or various kinds of heating media, infrared rays, and electromagnetic waves. Heating is performed by applying heat from the coated surface side or the support side.

The heating temperature is preferably 100 degrees C. or higher but 170 degrees C. or lower. It has been confirmed that when the heating temperature is lower than 100 degrees C., the organic solvent in the film cannot be removed sufficiently and the electrophotographic property and the wear resistance become poor. On the other hand, when the charge transport layer is treated at a temperature higher than 170 degrees C., the charge transport layer may have an orange peel-like defect or a crack on the surface, or may be peeled from the interface with an adjoining layer. Escape of a volatile component in the photoconductive layer to the outside is unfavorable because a desired electric property may not be obtained.

<Protective Layer>

In the photoconductor of the present disclosure, a protective layer may be provided over the photoconductive layer in order to protect the photoconductive layer. Examples of the material used for the protective layer include resins such as ABS resins, ACS resins, olefin-vinyl monomer copolymers, chlorinated polyether, aryl resins, phenol resins, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acrylic resins, polymethylpentene, polypropylene, polyphenylene oxide, polysulfone, polystyrene, polyallylate, AS resins, butadiene-styrene copolymers, polyurethane, polyvinyl chloride, polyvinylidene chloride, and epoxy resins. Particularly, polycarbonate or polyallylate is effective and useful in terms of dispersibility of a filler, a residual potential, and coating film defects.

A filler material can be added in the protective layer of the photoconductor in order to improve wear resistance. Examples of a solvent that can be used include all of the solvents that can be used in the charge transport layer, such as tetrahydrofuran, dioxane, toluene, dichloromethane, monochlorobenzene, dichloroethane, cyclohexanone, methyl ethyl ketone, and acetone. Note, however, that a solvent having a high viscosity is preferable for dispersion, but a solvent having a high volatility is preferable for coating. When there is no solvent that satisfies these conditions, it is possible to use 2 or more solvents each having any of these properties as a mixture. Such a mixture may have a significant effect on the dispersibility of the filler and a residual potential.

Addition of any charge transport substance presented as an example of the charge transport substance in the charge transport layer in the protective layer is effective and useful for suppressing a residual potential and improving an image quality.

As the method for forming the protective layer, existing methods such as a dip coating method, a spray coating method, a bead coating method, a nozzle coating method, a spinner coating method, and a ring coating method can be used. Particularly, a spray coating method is preferable in terms of uniformity of the coating film.

[In the Case of Single-layer Configuration]

As illustrated in FIG. 1, a photoconductive layer having a single-layer configuration includes a single-layer photoconductive layer 26 having a charge generating function and a charge transport function at the same time. The single-layer photoconductive layer 26 can be formed by dissolving or dispersing a charge generating substance, a charge transport substance, a binder resin, and inorganic particles in an appropriate solvent, and coating and drying the obtained liquid. As needed, for example, a plasticizer, a leveling agent, and an antioxidant may be added.

As the binder resin, not only any binder resin presented above as an example of the binder resin in the charge transport layer, but also any binder resin presented above as an example of the binder resin in the charge generating layer may be used as a mixture. A polymeric charge transport substance can also be suitably used. Relative to 100 parts by mass of the binder resin, the amount of the charge generating substance is preferably from 5 parts by mass through 40 parts by mass and the amount of the charge transport substance is preferably 190 parts by mass or less and more preferably from 50 parts by mass through 150 parts by mass.

The single-layer photoconductive layer 26 can be formed by dispersing the charge generating substance, the binder resin, and the charge transport substance in a solvent such as tetrahydrofuran, dioxane, dichloroethane, and cyclohexane with, for example, a disperser to produce a coating liquid, and coating the coating liquid over the conductive support 21 by such a method as a clip coating method, a spray coating method, a bead coating method, and a ring coating method.

The thickness of the single-layer photoconductive layer 26 is preferably from 5 micrometers through 25 micrometers.

(Additive Materials)

In the electrophotographic photoconductor of the present disclosure, an antioxidant, a plasticizer, a lubricant, an ultraviolet absorber, and a leveling agent that are commercially available may be added in the photoconductive layer and the surface layer, with a view to improvement of environmental resistance, particularly, prevention of sensitivity degradation and rise of a residual potential. The addition amount of these additive agents may be appropriately selected depending on the intended purpose, and is preferably from 0.01% by mass through 10% by mass relative to the total mass of the layer to which the additive agents are added.

(Conductive Support)

The conductive support is not particularly limited and may be appropriately selected depending on the intended purpose, so long as the conductive support has a conductivity represented by a volume resistivity of $10^{10}$ Ω·cm or lower. Examples of conductive supports that can be used include: supports obtained by coating film-shaped or cylindrical plastic or paper with a metal such as aluminum, nickel, chromium, nichrome, copper, gold, silver, and platinum or a metal oxide such as tin oxide and indium oxide by vapor deposition or sputtering; and plates formed of, for example, aluminum, aluminum alloys, nickel, and stainless steel and tubes obtained by shaping these plates into elementary tubes by machining methods such as extruding and drawing and applying surface processing such as cutting, super-finishing, and polishing to the elementary tubes. Endless nickel belts and endless stainless-steel belts can also be used as the support.

In the present disclosure, a product obtained by forming a conductive layer over the support by coating the support with a conductive powder dispersed in an appropriate binder resin can also be used as the conductive support.

Examples of the conductive powder include carbon black, acetylene black, metal powders of, for example, aluminum, nickel, iron, nichrome, copper, zinc, and silver, and metal oxide powders of, for example, conductive tin oxide and ITO. Examples of the binder resin to be used in combination include thermoplastic, thermosetting, or photocurable resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyallylate resins, phenoxy resins, polycarbonate resins, cellulose acetate resins, ethyl cellulose resins, polyvinyl butyral resins, polyvinyl formal resins, polyvinyl toluene resins, poly-N-vinyl carbazole, acrylic resins, silicone resins, epoxy resins, melamine resins, urethane resins, phenol resins, and alkyd resins.

The conductive layer can be formed by dispersing the conductive powder and the binder resin in an appropriate solvent such as tetrahydrofuran, dichloromethane, methyl ethyl ketone, and toluene, and coating the obtained liquid.

Moreover, as the support of the present disclosure, it is also suitable to use a product obtained by providing an appropriate cylindrical base with, as the conductive layer, a heat-shrinkable tube obtained by adding the conductive powder in a material such as polyvinyl chloride, polypropylene, polyester, polystyrene, polyvinylidene chloride, polyethylene, chlorinated rubbers, and Teflon (registered trademark).

(Image Forming Apparatus)

An image forming apparatus of the present disclosure includes at least an electrophotographic photoconductor, a charging unit configured to charge the surface of the electrophotographic photoconductor, an exposing unit configured to expose the charged surface of the electrophotographic photoconductor to light to form an electrostatic latent image, a developing unit configured to develop the electrostatic latent image with a toner to form a visible image, and a transfer unit configured to transfer the visible image onto a recording medium, and further includes other units appropriately selected as needed, such as a fixing unit, a cleaning unit, a charge eliminating unit, a recycling unit, and a controlling unit.

The electrophotographic photoconductor is the electrophotographic photoconductor of the present disclosure.

An image forming method used in the present disclosure includes at least a charging step, an exposing step, a developing step, and a transfer step, and further includes other steps appropriately selected as needed, such as a fixing step, a cleaning step, a charge eliminating step, a recycling step, and a controlling step.

The image forming method used in the present disclosure can be favorably performed by the image forming apparatus of the present disclosure. The charging step can be performed by the charging unit. The exposing step can be performed by the exposing unit. The developing step can be performed by the developing unit. The transfer step can be performed by the transfer unit. The fixing step can be performed by the fixing unit. The cleaning step can be performed by the cleaning unit. The other steps can be performed by the other units.

—Charging Step and Charging Unit—

The charging step is a step of charging the surface of the electrophotographic photoconductor, and is performed by the charging unit.

The charging unit is not particularly limited and may be appropriately selected depending on the intended purpose, so long as the charging unit is a unit that can apply a voltage to the surface of the electrophotographic photoconductor and charge the surface uniformly. A contactless charging unit configured to charge the electrophotographic photoconductor contactlessly is used.

Examples of the contactless charging unit include a contactless charger and a multi-stylus electrode utilizing corona discharge, a solid-state discharge element, and a conductive or semiconductive charging roller disposed at a minute gap from the electrophotographic photoconductor. Among these contactless charging units, corona discharge is particularly preferable.

The corona discharge is a contactless charging method of applying cations or anions generated upon a corona discharge in the air to the surface of the electrophotographic photoconductor. Examples of this contactless charging method include a corotron charger configured to apply a constant amount of charges to the electrophotographic photoconductor and a scorotron charger configured to apply a constant potential to the electrophotographic photoconductor.

The corotron charger is formed of; a casing electrode occupying a half of the space surrounding a discharge wire; and the discharge wire disposed in approximately the center of the casing electrode.

The scorotron charger is a product obtained by adding a grid electrode to the corotron charger. The grid electrode is disposed at a position apart from the surface of the electrophotographic photoconductor by a distance of from 1.0 mm through 2.0 mm.

—Exposing Step and Exposing Unit—

For example, exposure can be performed by exposing the surface of the electrophotographic photoconductor to light imagewise using the exposing unit.

The optical system for exposure is roughly classified into an analog optical system and a digital optical system. The analog optical system is an optical system configured to project a text directly on the electrophotographic photoconductor through an optical system. The digital optical system is an optical system configured to be supplied with image information in the form of an electric signal, and to convert the electric signal into an optical signal and expose the electrophotographic photoconductor to the optical signal to form an image.

The exposing unit is not particularly limited and may be appropriately selected depending on the intended purpose, so long as the exposing unit can expose the surface of the electrophotographic photoconductor charged by the charging unit to light imagewise as the image to be formed. Examples of the exposing unit include various exposing devices of, for example, a copier optical system, a rod lens array system, a laser optical system, a liquid crystal shutter optical system, and a LED optical system.

In the present disclosure, it is also possible to employ a backlighting system configured to apply light to the electrophotographic photoconductor from the back of the electrophotographic photoconductor for imagewise exposure.

—Developing Step and Developing Unit—

The developing step is a step of developing the electrostatic latent image with a toner or a developer to form a visible image.

Formation of the visible image can be performed by, for example, developing the electrostatic latent image with the toner or the developer, and can be performed by the developing unit.

The developing unit is not particularly limited and may be appropriately selected from known developing units, so long as the developing unit can perform development using the toner or the developer. A preferable developing unit includes at least a developing device in which the toner or the developer is contained and that can supply the toner or the developer to the electrostatic latent image by contacting the electrostatic latent image or contactlessly.

The developing device may be of a dry developing type or a wet developing type, or may be a single-color developing device or a multi-color developing device. A preferable developing device includes: a stirrer configured to stir the toner or the developer to triboelectrically charge the toner or the developer; and a rotatable magnet roller.

In the developing device, for example, the toner and the carrier are mixed and stirred, and the toner gets charged due to the friction of the mixing and stirring and supported on the surface of the rotating magnet roller in a chain-like form, to form a magnetic brush. The magnet roller is disposed near the electrophotographic photoconductor (photoconductor). Therefore, part of the toner constituting the magnetic brush formed on the surface of the magnet roller is transferred to the surface of the electrophotographic photoconductor by an electric attractive force. As a result, the electrostatic latent image is developed by the toner, to form a visible image of the toner on the surface of the electrophotographic photoconductor.

The developer contained in the developing device is a developer containing the toner. The developer may be a one-component developer or a two-component developer.

—Transfer Step and Transfer Unit—

The transfer step is a step of transferring the visible image onto a recording medium. A preferable mode uses an intermediate transfer medium to primarily transfer the visible image onto the intermediate transfer medium and then secondarily transfer the visible image onto the recording medium. A more preferable mode uses 2 or more colors of toners and preferably toners for full color as the toner, includes a primary transfer step of transferring visible images onto an intermediate transfer medium to form a combined transferred image and a secondary transfer step of transferring the combined transferred image onto a recording medium.

For example, transferring can be performed by charging the visible image on the electrophotographic photoconductor with a transfer charger, and can be performed by the transfer unit. A preferable mode of the transfer unit includes a primary transfer unit configured to transfer visible images onto an intermediate transfer medium to form a combined transferred image, and a secondary transfer unit configured to transfer the combined transferred image onto a recording medium.

The intermediate transfer medium is not particularly limited and may be appropriately selected depending on the intended purpose from known transfer media. A preferable example of the intermediate transfer medium is a transfer belt.

It is preferable that the transfer unit (the primary transfer unit or the secondary transfer unit) include at least a transfer device configured to charge the visible image formed on the electrophotographic photoconductor to be peeled to the recording medium. It is possible to provide 1 transfer unit, or 2 or more transfer units. Examples of the transfer device include a corona transfer device utilizing corona discharge, a transfer belt, a transfer roller, a pressure transfer roller, and an adhesive transfer device.

The recording medium is not particularly limited and may be appropriately selected depending on the intended purpose, so long as a developed, unfixed image can be transferred onto the recording medium. A representative example of the recording medium is plain paper. For example, a PET base for OHP can also be used.

——Fixing Step and Fixing Unit——

The fixing step is a step of fixing the visible image transferred onto the recording medium using a fixing device. The fixing step may be performed separately for each color toner when that color toner is transferred onto the recording medium. Alternatively, the fixing step may be performed at one time simultaneously in a state that different color toners are overlapped.

The fixing unit is not particularly limited and may be appropriately selected depending on the intended purpose. A fixing unit including a fixing member and a heat source configured to heat the fixing member is used.

Examples of the fixing member include a combination of an endless belt and a roller, and a combination of a roller and a roller. In order to reduce a warm-up time, realize energy saving, and enlarge a fixable width, a combination of an endless belt and a roller having a small heat capacity is preferable.

——Cleaning Step and Cleaning Unit——

The cleaning step is a step of removing the toner remaining on the electrophotographic photoconductor, and can be favorably performed by the cleaning unit. Instead of using the cleaning unit, a method for rubbing the residual toner to be charged uniformly with a rubbing member and collecting the residual toner with a developing roller may be employed.

The cleaning unit is not particularly limited and may be appropriately selected from known cleaners, so long as the cleaning unit can remove the electrophotographic toner remaining on the electrophotographic photoconductor. Preferable examples of the cleaning unit include a magnetic brush cleaner, an electrostatic brush cleaner, a magnetic roller cleaner, a blade cleaner, a brush cleaner, and a web cleaner.

——Charge Eliminating Step and Charge Eliminating Unit——

The charge eliminating step is a step of applying a charge eliminating bias to the electrophotographic photoconductor to eliminate charges, and can be favorably performed by the charge eliminating unit.

The charge eliminating unit is not particularly limited and may be appropriately selected from known charge eliminating devices, so long as the charge eliminating unit can apply a charge eliminating bias to the electrophotographic photoconductor. Preferable examples of the charge eliminating unit include a charge eliminating lamp.

——Recycling Step and Recycling Unit——

The recycling step is a step of recycling the toner removed in the cleaning step to the developing unit, and can be favorably performed by the recycling unit. The recycling unit is not particularly limited. Examples of the recycling unit include known conveying units.

——Controlling Step and Controlling Unit——

The controlling step is a step of controlling each of the steps described above, and can be favorably performed by the controlling unit.

The controlling unit is not particularly limited and may be appropriately selected depending on the intended purpose, so long as the controlling unit can control the operation of each unit. Examples of the controlling unit include devices such as a sequencer and a computer.

Next, the image forming apparatus and a process cartridge of the present disclosure will be described in detail with reference to the drawings.

As described above, using the electrophotographic photoconductor of the present disclosure, the image forming apparatus of the present disclosure performs a process of subjecting the photoconductor to at least charging, image exposure, and development, then transferring and fixing a toner image onto an image support medium (transfer paper), and cleaning the surface of the photoconductor.

As the case may be, an image forming apparatus configured to transfer and develop an electrostatic latent image directly on a recording medium does not necessarily include the above-described process on the photoconductor.

Figure 5:
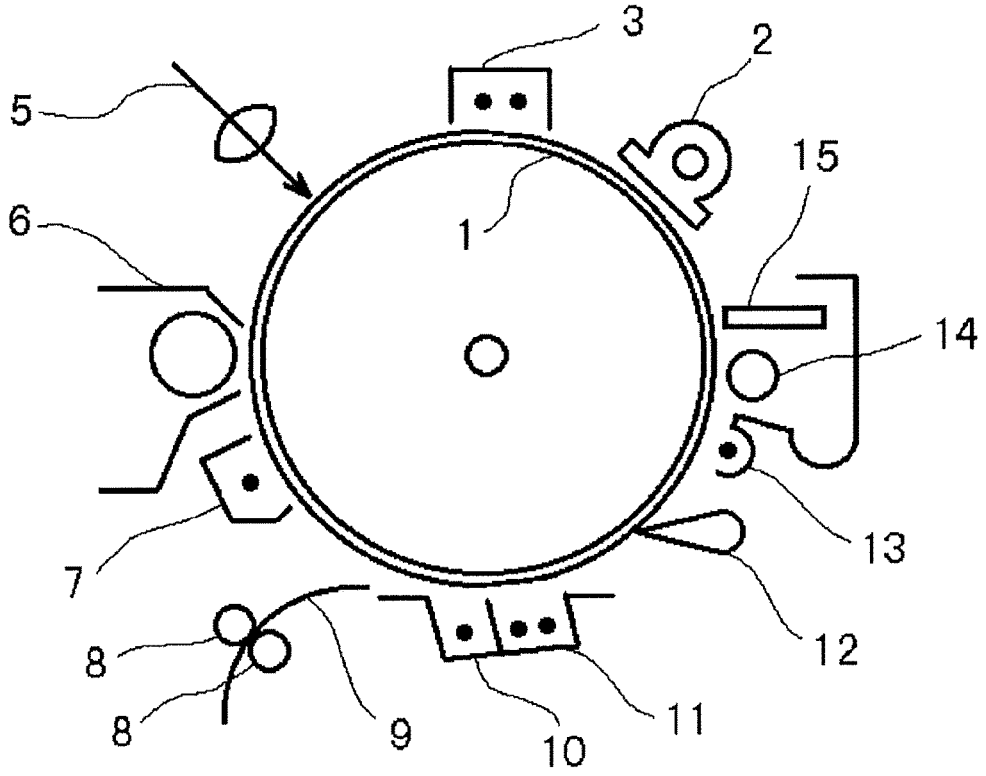
FIG. 5 is a schematic view illustrating an example of an image forming apparatus.

FIG. 5 is a schematic diagram illustrating an example of the image forming apparatus. A charger 3 is used as a unit configured to charge the photoconductor averagely. As this charging unit, for example, a corotron device, a scorotron device, a solid-state discharge element, a multi-stylus electrode, a roller charging device, or a conductive brush device is used, and known methods can be used.

Next, an image exposing unit 5 is used to form an electrostatic latent image on the photoconductor 1 charged uniformly. As the light source, all kinds of light emitting materials can be used, such as a fluorescent lamp, a tungsten lamp, a halogen lamp, a mercury lamp, a sodium-vapor lamp, a light emitting diode (LED), a laser diode (LD), and electroluminescence (EL). For irradiation with only light in a desired wavelength range, various filters can be used, such as a sharp cut filter, a band pass filter, a near-infrared cut filter, a dichroic filter, an interference filter, and a color conversion filter.

Next, a developing unit 6 is used to visualize the electrostatic latent image formed on the photoconductor 1. Examples of the developing method include a one-component developing method and a two-component developing method using a dry toner, and a wet developing method using a wet toner. When the photoconductor is charged positively (or negatively) for image exposure, a positive (or negative) electrostatic latent image is formed on the surface of the photoconductor. When the electrostatic latent image is developed with a toner (electroscopic particles) having a negative (or positive) polarity, a positive image is obtained. When the electrostatic latent image is developed with a toner having a positive (or negative) polarity, a negative image is obtained.

Next, a recording medium is sent out by rollers 8, and a transfer charger 10 is used to transfer the toner image visualized on the photoconductor onto the recording medium 9. A pre-transfer charger 7 may also be used in order to perform transfer more favorably. As these transfer units, a transfer charger, an electrostatic transfer system using a bias roller, mechanical transfer systems such as an adhesive transfer system and a pressure transfer system, and a magnetic transfer system can be used. As the electrostatic transfer system, the charging unit described above can be used.

Next, a separation charger 11 and a separation claw 12 are used as a unit configured to separate the recording medium 9 from the photoconductor 1. Other examples of the separation unit include electrostatic attraction-induced separation, side edge belt separation, leading edge gripping conveyance, and self-stripping. As the separation charger 11, the charging unit described above can be used.

Next, a fur brush 14 and a cleaning blade 15 are used to clean the toner remaining on the photoconductor after transfer. A pre-cleaning charger 13 may be used in order to perform cleaning more efficiently. Other examples of the cleaning unit include a web system and a magnet brush system. One of these cleaning units may be used alone or two or more of these cleaning units may be used in combination.

Further, as needed, the charge eliminating unit is used in order to eliminate the latent image on the photoconductor. As the charge eliminating unit, a charge eliminating lamp 2 or a charge eliminating charger is used. The light source for exposure and the charging unit described above can be used as these charging eliminating units, respectively.

Known systems can be used for processes that are not close to the photoconductor, such as text scanning, paper feeding, fixing, and paper ejection.

The image forming apparatus of the present disclosure may be mounted with a process cartridge. This process cartridge may be mountable on and demountable from the image forming apparatus.

Figure 6:
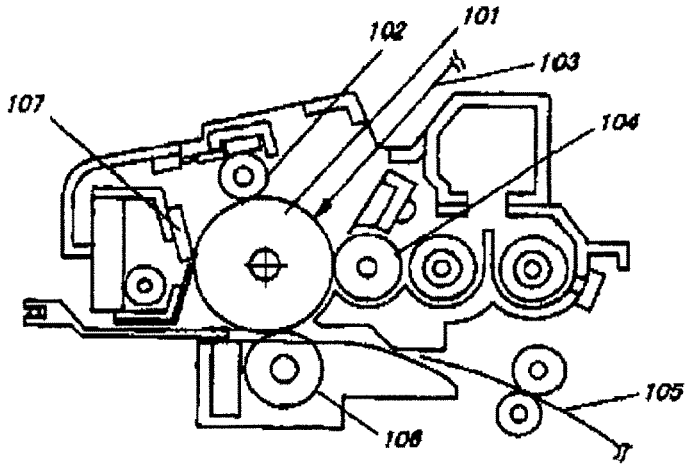
FIG. 6 is a schematic view illustrating an example of a process cartridge.

An example of the process cartridge is illustrated in FIG. 6.

The process cartridge is a device (part) including a photoconductor 101 as a built-in unit, further including at least one of a charging unit 102, a developing unit 104, a transfer unit 106, a cleaning unit 107, and a charge eliminating unit, and having a configuration mountable on and demountable from the main body of the image forming apparatus.

An image forming process by the process cartridge of FIG. 6 will be described. While the photoconductor 101 is being rotated clockwise, an electrostatic latent image is formed on the surface of the photoconductor through charging by the charging unit 102 and exposure by an exposing unit 103. This electrostatic latent image is developed with a toner by the developing unit 104, and the toner-developed image is transferred by the transfer unit 106 onto a recording medium 105 and printed out. Next, the surface of the photoconductor after image transfer is cleaned by the cleaning unit 107, and charges are eliminated from the surface of the photoconductor by the charging eliminating unit. Then, the series of operation described above is repeated again.

EXAMPLES

The present disclosure will be described in detail by way of Examples and Comparative Examples. The present disclosure should not be construed as being limited to Examples presented below.

Comparative Example 1

An undercoat layer coating liquid was prepared by mixing the materials described below to produce a pre-metal oxide particle dispersion slurry, and stirring the produced slurry with φ0.5 zirconia beads and a vibrating mill for 2 hours.

[Undercoat Layer Coating Liquid]

Alkyd resin: 12 parts by mass (BECKOSOL 1307-60-EL, available from DIC Corporation)

Melamine resin: 8 parts by mass (SUPER BECKAMINE G-821-60, available from DIC Corporation)

Titanium oxide: 80 parts by mass (PT-401, with a particle diameter of 70 nm and a powder resistance of $4.1\times10^5$ Ω·cm, available from Ishihara Sangyo Kaisha, Ltd.)

Methyl ethyl ketone: 120 parts by mass

In Examples and Comparative Examples, a powder resistance means a volume resistivity of a compacted powder formed of metal oxide particles compacted to have a volume filling ratio of 50 vol %, and a particle diameter means an average primary particle diameter.

A charge generating layer coating liquid was prepared by mixing the materials described below to produce a pre-dispersion slurry, and stirring the slurry with φ1 glass beads and a bead mill for 8 hours.

[Charge Generating Layer Coating Liquid]

Titanyl phthalocyanine: 8 parts by mass

Figure 7:
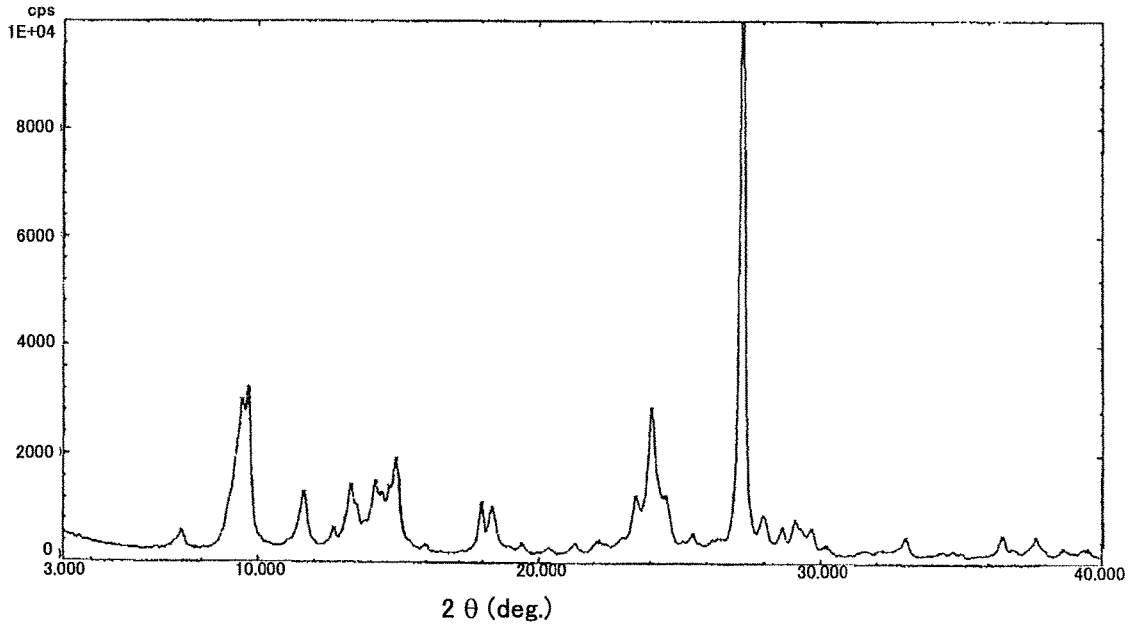
FIG. 7 plots a powder X-ray diffraction spectrum of titanyl phthalocyanine used in Examples.

Polyvinyl butyral (ESLEC BX-1 available from Sekisui Chemical Co., Ltd.): 5 parts by mass Methyl ethyl ketone: 400 parts by mass FIG. 7 plots a powder X-ray diffraction spectrum of titanyl phthalocyanine used.

Using the undercoat layer coating liquid and the charge generating layer coating liquid prepared as described above and a charge transport layer coating liquid prepared as described below, an undercoat layer, a charge generating layer, and a charge transport layer were sequentially coated over a φ30 mm aluminum cylinder, and dried, to form an undercoat layer having a thickness of 5.0 micrometers, a charge generating layer having a thickness of 0.2 micrometers, and a charge transport layer having a thickness of 35 micrometers.

[Charge Transport Layer Coating Liquid]

Bisphenol Z polycarbonate: 10 parts by mass (PANLITE TS-2050, available from Teijin Limited)

Charge transport compound represented by structural formula (2) below: 7 parts by mass Tetrahydrofuran: 100 parts by mass Reactive silicone compound: 0.5 parts by mass (Polysiloxane modified with methacrylic at both ends: X-22-164A, available from Shin-Etsu Chemical Co., Ltd.)

Structural formula (2)

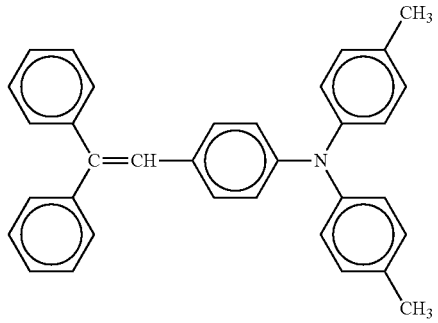

Example 1

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 12 parts by mass (BECKOSOL 1307-60-EL, available from DIC Corporation)

Melamine resin: 8 parts by mass (SUPER BECKAMINE G-821-60, available from DIC Corporation)

Titanium oxide: 80 parts by mass (PT-401, with a particle diameter of 70 nm and a powder resistance of $4.1\times10^5$ Ω·cm, available from Ishihara Sangyo Kaisha, Ltd.)

4-Methyl salicylic acid (compound 1): 1.6 parts by mass

Methyl ethyl ketone: 120 parts by mass

Example 2

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 12 parts by mass (BECKOSOL 1307-60-EL, available from DIC Corporation)

Melamine resin: 8 parts by mass (SUPER BECKAMINE G-821-60, available from DIC Corporation)

Titanium oxide: 80 parts by mass (PT-401, with a particle diameter of 70 nm and a powder resistance of $4.1\times10^5$ Ω·cm, available from Ishihara Sangyo Kaisha, Ltd.)

3,5-Di-tert-butylsalicylic acid (compound 2): 1.6 parts by mass

Methyl ethyl ketone: 120 parts by mass

Comparative Example 2

An electrophotographic photoconductor was obtained in the same manner as in Comparative Example 1, except that titanium oxide in the undercoat layer coating liquid of Comparative Example 1 was changed to the material described below.

Zinc oxide: 80 parts by mass (FINEX-25, with a particle diameter of 60 nm and a powder resistance of $3.4\times10^7$ Ω·cm, available from Sakai Chemical Industry Co., Ltd.)

Example 3

An electrophotographic photoconductor was obtained in the same manner as in Example 1, except that titanium oxide in the undercoat layer coating liquid of Example 1 was changed to the material described below.

Zinc oxide: 80 parts by mass (FINEX-25, with a particle diameter of 60 nm and a powder resistance of $3.4\times10^7$ Ω·cm, available from Sakai Chemical Industry Co., Ltd.)

Example 4

An electrophotographic photoconductor was obtained in the same manner as in Example 2, except that titanium oxide in the undercoat layer coating liquid of Example 2 was changed to the material described below.

Zinc oxide: 80 parts by mass (FINEX-25, with a particle diameter of 60 nm and a powder resistance of $3.4\times10^7$ Ω·cm, available from Sakai Chemical Industry Co., Ltd.)

Example 5

An electrophotographic photoconductor was obtained in the same manner as in Example 4, except that the film thickness of the undercoat layer of Example 4 was changed to 15 micrometers.

Comparative Example 3

An electrophotographic photoconductor was obtained in the same manner as in Comparative Example 1, except that titanium oxide in the undercoat layer coating liquid of Comparative Example 1 was changed to the material described below.

Al-doped zinc oxide (AZO): 80 parts by mass (PAZET CK-K, with a particle diameter of 13 nm and a powder resistance of $5.0\times10^6$ Ω·cm, available from Hakusui Tech Co., Ltd.)

Comparative Example 4

An electrophotographic photoconductor was obtained in the same manner as in Comparative Example 1, except that titanium oxide in the undercoat layer coating liquid of Comparative Example 1 was changed to the material described below.

Zinc oxide: 80 parts by mass (FINEX-30, with a particle diameter of 35 nm and a powder resistance of $2.8\times10^6$ Ω·cm, available from Sakai Chemical Industry Co., Ltd.)

Comparative Example 5

An electrophotographic photoconductor was obtained in the same manner as in Comparative Example 1, except that titanium oxide in the undercoat layer coating liquid of Comparative Example 1 was changed to the material described below.

Zinc oxide: 80 parts by mass (ZANO 10, with a particle diameter of 32 nm and a powder resistance of $6.4\times10^7$ Ω·cm, available from Umicore)

Comparative Example 6

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 10.0 parts by mass (BECKOSOL 1307-60-EL, available from DIC Corporation)

Melamine resin: 6.7 parts by mass (SUPER BECKAMINE G-821-60, available from DIC Corporation)

Titanium oxide: 83.3 parts by mass (CR-EL, with a particle diameter of 250 nm and a powder resistance of $7.2\times10^7$ Ω·cm, available from Ishihara Sangyo Kaisha, Ltd.)

Methyl ethyl ketone: 120 parts by mass

Comparative Example 7

An electrophotographic photoconductor was obtained in the same manner as in Comparative Example 1, except that titanium oxide in the undercoat layer coating liquid of Comparative Example 1 was changed to the material described below.

Al-doped titanium oxide: 80 parts by mass (ZANO AL, with a particle diameter of 32 nm and a powder resistance of $8.8\times10^6$ Ω·cm, available from Ishihara Sangyo Kaisha, Ltd.)

Example 6

An electrophotographic photoconductor was obtained in the same manner as in Example 1, except that titanium oxide in the undercoat layer coating liquid of Example 1 was changed to the material described below.

Al-doped titanium oxide: 80 parts by mass (ZANO AL, with a particle diameter of 32 nm and a powder resistance of $8.8\times10^6$ Ω·cm, available from Ishihara Sangyo Kaisha, Ltd.)

Example 7

An electrophotographic photoconductor was obtained in the same manner as in Example 2, except that titanium oxide in the undercoat layer coating liquid of Example 2 was changed to the material described below.

Al-doped titanium oxide: 80 parts by mass (ZANO AL, with a particle diameter of 32 nm and a powder resistance of $8.8\times10^6$ Ω·cm, available from Ishihara Sangyo Kaisha, Ltd.)

Comparative Example 8

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 12 parts by mass (BECKOSOL 1307-60-EL, available from DIC Corporation)

Melamine resin: 8 parts by mass (SUPER BECKAMINE G-821-60, available from DIC Corporation)

Methyl ethyl ketone: 120 parts by mass

Comparative Example 9

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 12 parts by mass (BECKOSOL 1307-60-EL, available from DIC Corporation)

Melamine resin: 8 parts by mass (SUPER BECKAMINE G-821-60, available from DIC Corporation)

3,5-Di-tert-butylsalicylic acid: 1.6 parts by mass

Methyl ethyl ketone: 120 parts by mass

Comparative Example 10

An electrophotographic photoconductor was obtained in the same manner as in Comparative Example 1, except that titanium oxide in the undercoat layer coating liquid of Comparative Example 1 was changed to the material described below.

Al-doped zinc oxide: 80 parts by mass (PAZET CK, with a particle diameter of 41 nm and a powder resistance of $5.0\times10^3$ Ω·cm, available from Hakusui Tech Co., Ltd.)

Comparative Example 11

An electrophotographic photoconductor was obtained in the same manner as in Comparative Example 1, except that titanium oxide in the undercoat layer coating liquid of Comparative Example 1 was changed to the material described below.

Ga-doped zinc oxide (GZO): 80 parts by mass (PAZET GK40, with a particle diameter of 31 nm and a powder resistance of $1.9\times10^3$ Ω·cm, available from Hakusui Tech Co., Ltd.)

Comparative Example 12

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 20.0 parts by mass (BECKOSOL 1307-60-EL, available from DIC Corporation)

Melamine resin: 13.3 parts by mass (SUPER BECKAMINE G-821-60, available from DIC Corporation)

Zinc oxide: 66.6 parts by mass (FINEX-25, with a particle diameter of 60 nm and a powder resistance of $3.4\times10^7$ Ω·cm, available from Sakai Chemical Industry Co., Ltd.)

Methyl ethyl ketone: 120 parts by mass

Comparative Example 13

An electrophotographic photoconductor was obtained in the same manner as in Comparative Example 1, except that the undercoat layer coating liquid of Comparative Example 1 was changed to the composition described below.

[Undercoat Layer Coating Liquid]

Alkyd resin: 8.0 parts by mass (BECKOSOL 1307-60-EL, available from DIC Corporation)

Melamine resin: 5.3 parts by mass (SUPER BECKAMINE G-821-60, available from DIC Corporation)

Zinc oxide: 86.7 parts by mass (FINEX-25, with a particle diameter of 60 nm and a powder resistance of $3.4\times10^7$ Ω·cm, available from Sakai Chemical Industry Co., Ltd.)

Methyl ethyl ketone: 120 parts by mass

Comparative Example 14

An electrophotographic photoconductor was obtained in the same manner as in Example 4, except that the film thickness of the undercoat layer of Example 4 was changed to 1.5 micrometers.

Comparative Example 15

An electrophotographic photoconductor was obtained in the same manner as in Example 4, except that the film thickness of the undercoat layer of Example 4 was changed to 25 micrometers.

The electrophotographic photoconductors of Examples 1 to 7 and Comparative Examples 1 to 15 produced as described above were tested in the manner described below.

<Evaluation of Electrostatic Property after Actual Apparatus Became Fatigued and Evaluation of Output Image>

A remodeled photoconductor unit obtained by removing parts (such as a cleaning blade, etc.) except for a charging unit from a photoconductor unit of RICOH MP C5503 available from Ricoh Company, Ltd. was used for a running test. The remodeled photoconductor unit mounded with each of the photoconductors produced in Examples and Comparative Examples was set in the remodeled apparatus of RICOH MP C5503 and configured to be capable of repeatedly performing only charging and developing without passing sheets. As the charging conditions, a charging roller was used to apply an alternating voltage obtained by superimposing an alternating-current voltage on a direct-current voltage, the alternating-current voltage was set to a peak-to-peak voltage Vpp of about 1.9 [kV] and a frequency f of about 1,700 [Hz], the direct-current voltage was set to −750 [V], and the rotation speed of the electrophotographic photoconductor was set to 230 mm/sec. As the developing conditions, a LD having a wavelength of 655 nm was used, and a 100% writing pattern (fully solid pattern) was used as a writing pattern. It was indicated by a passed charge calculation that under these conditions, the same level of electrostatic fatigue as imposed by passing 100,000 sheets (with a 5% test pattern/a difference of 550 V between a charging potential and an exposing potential/electrophotographic photoconductor capacitance of 110 pF/cm$^2$) would be imposed by an operation corresponding to about 2.1 hours of continuous sheet passing. In this evaluation, an electrostatic fatigue test corresponding to an operation for passing 100,000 sheets was performed using the remodeled apparatus described above, and image evaluation was performed using an evaluation apparatus described below.

For image evaluation, a remodeled apparatus of RICOH MP C5503 remodeled to include no initial idle-running process in an image outputting operation was used. As the toner, IMAGIO TONER TYPE 27 was used. As the sheet, MY PAPER (A4 size) available from NBS Ricoh was used. The surface potential of the photoconductor was set to −750 V at the start, and potentials in the apparatus (a potential after charging and a potential at the exposing unit) before and after the electrostatic fatigue were evaluated. Three images were continuously output in a half-tone output mode, and the states of dot reproduction on the output images were observed visually and with a microscope. The measurement results of the potentials in the apparatus and the image evaluation results are presented in Table 1-2.

The volume resistivity (coating film resistance) of the undercoat layer at a field intensity of $5\times10^6$ V/m is presented in Table 1-1.

TABLE 1-1

| Ex. | Undercoat layer | | | | | | | | | |
|---|---|---|---|---|---|---|---|---|---|---|
| | | Metal oxide particles | | | | | | Coating film | | |
| Comp. Ex. | Binder | Name | Maker | Chemical formula | Dope element | Particle diameter | Powder resistance | Coating film resistance MΩ · cm | Film thickness | Salicylic acid Kind |
| Comp. Ex. 1 | Alkyd/ melamine | PT-401M | Ishihara Sangyo | TiO2 | — | 70 nm | $4.1\times10^5$ | 0.0080 | 5 micrometers | — |
| Ex. 1 | Alkyd/ melamine | PT-401M | Ishihara Sangyo | TiO2 | — | 70 nm | $4.1\times10^5$ | 0.0065 | 5 micrometers | Compound 1 |
| Ex. 2 | Alkyd/ melamine | PT-401M | Ishihara Sangyo | TiO2 | — | 70 nm | $4.1\times10^5$ | 0.0072 | 5 micrometers | Compound 2 |
| Comp. Ex. 2 | Alkyd/ melamine | FINEX-25 | Sakai Chemical | ZnO | — | 60 nm | $3.4\times10^7$ | 0.0110 | 5 micrometers | — |
| Ex. 3 | Alkyd/ melamine | FINEX-25 | Sakai Chemical | ZnO | — | 60 nm | $3.4\times10^7$ | 0.0099 | 5 micrometers | Compound 1 |
| Ex. 4 | Alkyd/ melamine | FINEX-25 | Sakai Chemical | ZnO | — | 60 nm | $3.4\times10^7$ | 0.0103 | 5 micrometers | Compound 2 |
| Ex. 5 | Alkyd/ melamine | FINEX-25 | Sakai Chemical | ZnO | — | 60 nm | $3.4\times10^7$ | 0.0103 | 15 micrometers | Compound 2 |
| Comp. Ex. 3 | Alkyd/ melamine | PAZET CK-K | Hakusui Tech | AZO | Al | 13 nm | $5.0\times10^6$ | 0.0095 | 5 micromotors | — |

TABLE 1-1-continued

| Ex. Comp. Ex. | Undercoat layer: Binder | Metal oxide particles: Name | Maker | Chemical formula | Dope element | Particle diameter | Powder resistance | Coating film: Coating film resistance MΩ · cm | Film thickness | Salicylic acid Kind |
|---|---|---|---|---|---|---|---|---|---|---|
| Comp. Ex. 4 | Alkyd/melamine | FINEX-30 | Sakai Chemical | ZnO | — | 35 nm | $2.8 \times 10^6$ | 0.0087 | 5 micrometers | — |
| Comp. Ex. 5 | Alkyd/melamine | ZANO 10 | Umicore | ZnO | — | 32 nm | $6.4 \times 10^7$ | 0.0142 | 5 micrometers | — |
| Comp. Ex. 6 | Alkyd/melamine | CR-EL | Ishihara Sangyo | TiO2 | — | 250 nm | $7.2 \times 10^7$ | 0.0183 | 5 micrometers | — |
| Comp. Ex. 7 | Alkyd/melamine | ZANO AL | Umicore | AZO | Al | 32 nm | $8.8 \times 10^6$ | 0.0093 | 5 micrometers | — |
| Ex. 6 | Alkyd/melamine | ZANO AL | Umicore | AZO | Al | 32 nm | $8.8 \times 10^6$ | 0.0087 | 5 micrometers | Compound 1 |
| Ex. 7 | Alkyd/melamine | ZANO AL | Umicore | AZO | Al | 32 nm | $8.8 \times 10^6$ | 0.0091 | 5 micrometers | Compound 2 |
| Comp. Ex. 8 | Alkyd/melamine | — | — | — | — | — | — | | 5 micrometers | — |
| Comp. Ex. 9 | Alkyd/melamine | — | — | — | — | — | — | | 5 micrometers | Compound 2 |
| Comp. Ex. 10 | Alkyd/melamine | PAZET CK | Hakusui Tech | AZO | Al | 41 nm | $5.0 \times 10^3$ | 0.00023 | 5 micrometers | — |
| Comp. Ex. 11 | Alkyd/melamine | PAZET GK40 | Hakusui Tech | GZO | Ga | 31 nm | $1.9 \times 10^3$ | 0.00011 | 5 micrometers | — |
| Comp. Ex. 12 | Alkyd/melamine | FINEX-25 | Sakai Chemical | ZnO | — | 60 nm | $3.4 \times 10^7$ | 0.0460 | 5 micrometers | — |
| Comp. Ex. 13 | Alkyd/melamine | FINEX-25 | Sakai Chemical | ZnO | — | 60 nm | $3.4 \times 10^7$ | 0.00088 | 5 micrometers | — |
| Comp. Ex. 14 | Alkyd/melamine | FINEX-25 | Sakai Chemical | ZnO | — | 60 nm | $3.4 \times 10^7$ | 0.0103 | 1.5 micromotors | Compound 2 |
| Comp. Ex. 15 | Alkyd/melamine | FINEX-25 | Sakai Chemical | ZnO | — | 60 nm | $3.4 \times 10^7$ | 0.0103 | 25 micrometers | Compound 2 |

TABLE 1-2

| Ex. Comp. Ex. | Potential at exposing unit: Before sheet passing | After sheet passing | Image evaluation (residual image): Before sheet passing | After sheet passing | Image evaluation Others |
|---|---|---|---|---|---|
| Comp. Ex. 1 | −100 | −150 | 5.0 | 4.5 | Good |
| Ex. 1 | −95 | −125 | 5.0 | 4.5 | Good |
| Ex. 2 | −85 | −110 | 5.0 | 4.5 | Good |
| Comp. Ex. 2 | −80 | −125 | 5.0 | 5.0 | Good |
| Ex. 3 | −70 | −80 | 5.0 | 5.0 | Good |
| Ex. 4 | −60 | −65 | 5.0 | 5.0 | Good |
| Ex. 5 | −70 | −75 | 5.0 | 5.0 | Good |
| Comp. Ex. 3 | −85 | −155 | 5.0 | 4.0 | Good |
| Comp. Ex. 4 | −90 | −155 | 5.0 | 4.0 | Good |
| Comp. Ex. 5 | −90 | −155 | 5.0 | 4.0 | Good |
| Comp. Ex. 6 | −135 | −200 | 5.0 | 4.0 | Good |
| Comp. Ex. 7 | −90 | −155 | 5.0 | 4.0 | Good |
| Ex. 6 | −90 | −125 | 5.0 | 4.5 | Good |
| Ex. 7 | −85 | −115 | 5.0 | 4.5 | Good |
| Comp. Ex. 8 | −680 | — | — | — | Density degradation starting from initial period |
| Comp. Ex. 9 | −665 | — | — | — | Density degradation starting from initial period |
| Comp. Ex. 10 | −85 | −120 | 5.0 | 5.0 | Background fog |
| Comp. Ex. 11 | −75 | −110 | 5.0 | 5.0 | Background fog |
| Comp. Ex. 12 | −285 | −405 | 4.0 | 2.0 | Density degradation over time |

TABLE 1-2-continued

| Ex. Comp. Ex. | Potential at exposing unit: Before sheet passing | Potential at exposing unit: After sheet passing | Image evaluation (residual image): Before sheet passing | Image evaluation (residual image): After sheet passing | Image evaluation Others |
|---|---|---|---|---|---|
| Comp. Ex. 13 | −65 | −75 | 5.0 | 5.0 | Background fog |
| Comp. Ex. 14 | −60 | −70 | 5.0 | 5.0 | Background fog |
| Comp. Ex. 15 | −95 | −115 | 5.0 | 3.0 | Good |

Note 1)
Evaluation was given up for Comparative Examples 8 and 9 because the potentials at the exposing unit were high.
Note 2)
Evaluation of residual image
Rank 5: No residual image was generated.
Rank 4.5: Only negligible residual image was generated.
Rank 4: Slight residual image was generated.
Rank 3: Apparent residual image was generated.
Rank 2: Apparent residua image was generated (between Rank 1 and Rank 3).
Rank 1: The density at the residual image generated portion was abnormal.

From the results of Table 1-2, all of the electrophotographic photoconductors obtained in Examples achieved low potentials at the exposing unit, a small difference between before and after the test, and excellent image evaluation values. Accordingly, it was proved that the electrophotographic photoconductors obtained in Examples had an extremely high electric property stability even through repetition of image outputting and were able to suppress as much as possible occurrence of, particularly, residual image among image defects and to output stable images for a long term.

On the other hand, Comparative Examples 1 to 7 free of the salicylic acid derivative represented by general formula (1) above had a particularly large difference between the potentials at the exposing unit before and after the test. Comparative Examples 8 and 9 using an undercoat layer free of metal oxide particles had an extremely high initial residual potential, and were not able to be subjected to the test. This was considered due to that the undercoat layer was free of a constituent component having a charge transport function. Moreover, Comparative Example 10, which used gallium-doped zinc oxide though, had an extremely large difference between the potentials at the exposing unit before and after the test because no salicylic acid derivative was used, and failed to constitute a configuration that would be able to endure a long time of use. A specific cause of this phenomenon was unknown, but it was estimated that because the metal oxide particles not only had a poor dispersibility but also were not coated with an organic material on the surface, charge traps attributable to the particles significantly influenced. Comparative Examples 11 and 12 had a tendency of having high potentials at the exposing unit both initially and after the test, and Comparative Example 4 free of a salicylic acid derivative particularly had a large difference between the potentials at the exposing unit before and after the test. This was considered to suggest expression of a tendency that use of metal oxide particles having a high resistivity led to a high initial potential and the problem of image density degradation, and no use of the salicylic acid derivative of the present disclosure led to a particularly large difference between before and after the test. Reflecting these results of the potentials at the exposing unit, the results of image density degradation were obtained.

Regarding the output images after the test, the photoconductors of Examples all had almost no difference between before and after the test, indicating an excellent stability. On the other hand, Comparative Examples 10 and 12 were not able to obtain a sufficient dot formation on the output images after the test, and incurred image deletion.

Comparative Example 13 incurred background fog, because the volume resistivity of the undercoat layer was lower than the lower limit specified in the present disclosure.

Comparative Example 14 incurred background fog, because the thickness of the undercoat layer was less than the lower limit specified in the present disclosure.

Comparative Example 15 achieved a poor result in the residual image evaluation, because the thickness of the undercoat layer was greater than the upper limit specified in the present disclosure.

What is claimed is:

1. An electrophotographic photoconductor, comprising:

a conductive support;

an undercoat layer; and a photoconductive layer;

wherein:

the undercoat layer and the photoconductive layer are provided over the conductive support in the order of recited;

the undercoat layer comprises metal oxide particles, a binder, and a salicylic acid derivative;

the metal oxide particles comprise zinc oxide particles doped with a Group XIII element;

a compacted powder of the metal oxide particles at a volume filling ratio of 50 vol % has a volume resistivity of $1\times10^5$ Ω·cm or higher but $1\times10^8$ Ω·cm or lower;

the undercoat layer has a volume resistivity of $0.001\times10^6$ Ω·cm or higher but $0.02\times10^6$ Ω·cm or lower at a field intensity of $5\times10^6$ V/m;

the undercoat layer has a thickness of 2 micrometers or greater but 20 micrometers or less; and the salicylic acid derivative is a salicylic acid derivative according to formula (1):

(1)

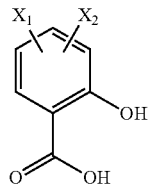

where $X_1$ and $X_2$ represent a hydrogen atom, an alkyl group, an alkoxy group, an aralkyl group, an aryl group, a hydroxyl group, a carboxyl group, or a carbonyl group, and $X_1$ and $X_2$ may be same or different.

2. The electrophotographic photoconductor according to claim 1, wherein one or both of $X_1$ and $X_2$ in the salicylic acid derivative according to formula (1) is/are a hydrogen atom, an alkyl group that comprises 4 or more carbon atoms, an alkoxy group that comprises 4 or more carbon atoms, or an aralkyl group that comprises 4 or more carbon atoms.

3. The electrophotographic photoconductor according to claim 1, wherein a compacted powder of the metal oxide particles at a volume filling ratio of 50 vol % has a volume resistivity of $1\times10^6$ Ω·cm or higher but $1\times10^8$ Ω·cm or lower.

4. The electrophotographic photoconductor according to claim 1, wherein the undercoat layer has a volume resistivity of $0.005\times10^6$ Ω·cm or higher but $0.015\times10^6$ Ω·cm or lower at a field intensity of $5\times10^6$ V/m.

5. The electrophotographic photoconductor according to claim 1, wherein the metal oxide particles comprise zinc oxide particles doped with aluminum.

6. The electrophotographic photoconductor according to claim 1, wherein the metal oxide particles comprise zinc oxide particles doped with gallium.

7. An image forming apparatus comprising:

an electrophotographic photoconductor;

a charging unit configured to charge a surface of the electrophotographic photoconductor;

an exposing unit configured to expose the charged surface of the electrophotographic photoconductor to light to form an electrostatic latent image;

a developing unit configured to develop the electrostatic latent image with a toner to form a visible image; and a transfer unit configured to transfer the visible image onto a recording medium, wherein the electrophotographic photoconductor is the electrophotographic photoconductor according to claim 1.

8. An image forming apparatus comprising a process cartridge that comprises:

an electrophotographic photoconductor; and at least one unit selected from the group consisting of a charging unit configured to charge a surface of the electrophotographic photoconductor, an exposing unit configured to expose the charged surface of the electrophotographic photoconductor to light to form an electrostatic latent image, a developing unit configured to develop the electrostatic latent image with a toner to form a visible image, a transfer unit configured to transfer the visible image onto a recording medium, and a cleaning unit configured to remove the toner remaining on the surface of the electrophotographic photoconductor after a transfer process, wherein the process cartridge is mountable on and demountable from the image forming apparatus, and wherein the electrophotographic photoconductor is the electrophotographic photoconductor according to claim 1.

9. A process cartridge comprising:

an electrophotographic photoconductor; and at least one unit selected from the group consisting of a charging unit configured to charge a surface of the electrophotographic photoconductor, an exposing unit configured to expose the charged surface of the electrophotographic photoconductor to light to form an electrostatic latent image, a developing unit configured to develop the electrostatic latent image with a toner to form a visible image, a transfer unit configured to transfer the visible image onto a recording medium, and a cleaning unit configured to remove the toner remaining on the surface of the electrophotographic photoconductor after a transfer process, wherein the electrophotographic photoconductor is the electrophotographic photoconductor according to claim 1.

10. An electrophotographic photoconductor, comprising:

a conductive support;

an undercoat layer; and a photoconductive layer;

wherein:

the undercoat layer and the photoconductive layer are provided over the conductive support in the order of recited;

the undercoat layer comprises metal oxide particles, a binder, and a salicylic acid derivative;

the metal oxide particles have an average primary particle diameter of 50 nm or greater but 200 nm or less;

a compacted powder of the metal oxide particles at a volume filling ratio of 50 vol % has a volume resistivity of $1\times10^5$ Ω·cm or higher but $1\times10^8$ Ω·cm or lower;

the undercoat layer has a volume resistivity of $0.001\times10^6$ Ω·cm or higher but $0.02\times10^6$ Ω·cm or lower at a field intensity of $5\times10^6$ V/m;

the undercoat layer has a thickness of 2 micrometers or greater but 20 micrometers or less; and the salicylic acid derivative is a salicylic acid derivative according to formula (1):

(1)

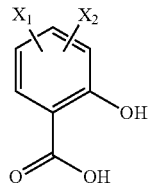

where $X_1$ and $X_2$ represent a hydrogen atom, an alkyl group, an alkoxy group, an aralkyl group, an aryl group, a hydroxyl group, a carboxyl group, or a carbonyl group, and $X_1$ and $X_2$ may be same or different.

11. The electrophotographic photoconductor according to claim 10, wherein the metal oxide particles comprise zinc oxide particles.

12. The electrophotographic photoconductor according to claim 10, wherein the metal oxide particles comprise zinc oxide particles doped with a Group XIII element.

13. The electrophotographic photoconductor according to claim 10, wherein a compacted powder of the metal oxide particles at a volume filling ratio of 50 vol % has a volume resistivity of $1\times10^6$ Ω·cm or higher but $1\times10^8$ Ω·cm or lower.

14. The electrophotographic photoconductor according to claim 10, wherein the undercoat layer has a volume resistivity of $0.005\times10^6$ Ω·cm or higher but $0.015\times10^6$ Ω·cm or lower at a field intensity of $5\times10^6$ V/m.

15. The electrophotographic photoconductor according to claim 10, wherein the metal oxide particles comprise zinc oxide particles doped with aluminum.

16. The electrophotographic photoconductor according to claim 10, wherein the metal oxide particles comprise zinc oxide particles doped with gallium.

17. An image forming apparatus comprising:

an electrophotographic photoconductor;

a charging unit configured to charge a surface of the electrophotographic photoconductor;

an exposing unit configured to expose the charged surface of the electrophotographic photoconductor to light to form an electrostatic latent image;

a developing unit configured to develop the electrostatic latent image with a toner to form a visible image; and a transfer unit configured to transfer the visible image onto a recording medium, wherein the electrophotographic photoconductor is the electrophotographic photoconductor according to claim 10.

18. An image forming apparatus comprising a process cartridge that comprises:

an electrophotographic photoconductor; and at least one unit selected from the group consisting of a charging unit configured to charge a surface of the electrophotographic photoconductor, an exposing unit configured to expose the charged surface of the electrophotographic photoconductor to light to form an electrostatic latent image, a developing unit configured to develop the electrostatic latent image with a toner to form a visible image, a transfer unit configured to transfer the visible image onto a recording medium, and a cleaning unit configured to remove the toner remaining on the surface of the electrophotographic photoconductor after a transfer process, wherein the process cartridge is mountable on and demountable from the image forming apparatus, and wherein the electrophotographic photoconductor is the electrophotographic photoconductor according to claim 10.

19. A process cartridge comprising:

an electrophotographic photoconductor; and at least one unit selected from the group consisting of a charging unit configured to charge a surface of the electrophotographic photoconductor, an exposing unit configured to expose the charged surface of the electrophotographic photoconductor to light to form an electrostatic latent image, a developing unit configured to develop the electrostatic latent image with a toner to form a visible image, a transfer unit configured to transfer the visible image onto a recording medium, and a cleaning unit configured to remove the toner remaining on the surface of the electrophotographic photoconductor after a transfer process, wherein the electrophotographic photoconductor is the electrophotographic photoconductor according to claim 10.

* * * * *